United States Patent [19]

Baker et al.

[11] 4,263,766

[45] Apr. 28, 1981

[54] IMPROVED TRANSFER APPLYING MACHINE

[75] Inventors: Max N. Baker, Rural Hall; Watson M. Dufour, Pfafftown; Julian R. Martin; John D. Welch, both of Winston-Salem; Donald R. Wilkinson, Clemmons; Marvin G. Woempner, Thomasville, all of N.C.

[73] Assignee: R. J. Reynolds Tobacco Co., Winston-Salem, N.C.

[21] Appl. No.: 838,186

[22] Filed: Sep. 30, 1977

[51] Int. Cl.[3] ..... B65B 61/20

[52] U.S. Cl. ..... 53/50; 53/71; 53/131; 53/137; 53/382; 101/27; 101/44; 156/358; 156/359; 156/361

[58] Field of Search ..... 156/235, 238, 240, 547, 156/542, DIG. 2, DIG. 33, 358, 359, 361, 363; 53/50, 131, 137, 71, 382, 70; 30/2; 101/27, 44

[56] References Cited

U.S. PATENT DOCUMENTS

| | | | |
|---|---|---|---|
| 2,574,087 | 11/1951 | Burhans | 30/2 |
| 2,595,122 | 4/1952 | Burhans | 30/2 |
| 3,001,310 | 9/1961 | Brownlee | 156/361 |
| 3,025,211 | 3/1962 | Winn | 156/542 |
| 3,306,807 | 2/1967 | Schlotthauer | 156/541 |
| 4,101,362 | 7/1978 | Baker et al. | 156/235 |

*Primary Examiner*—William A. Powell
*Assistant Examiner*—Thomas Bokan
*Attorney, Agent, or Firm*—Jones, Tullar & Cooper

[57] ABSTRACT

An improved machine for automatically applying transfers such as tax stamps to multiple packages contained in a carton is disclosed. The machine comprises a conveyor for advancing a carton through an opening station, where it is opened to expose the packages therein, through a stamping station, where tax stamps in the form of heat or water transfers or ink printing are applied to each of the packages by a movable platen, and through a closing station where the carton is closed and resealed. The machine is adjustable to accommodate a variety of carton and package sizes and to apply the transfers to a selected part of each package in the carton accurately, while using stock transfer sheets on which the transfers are mounted with a predetermined spacing that does not necessarily correspond to the spacing of packages within the carton. The various sizes are accommodated by means of an adjustable stop mechanism which interrupts the motion of each carton as it passes through the stamping station to thereby stop the carton at a selected location with respect to the transfer sheet and the stamp transfer platen. After the transfer has been applied, the stop mechanism is activated to allow the carton to continue its motion through the stamping station. The adjustable stop and the platen are shiftable laterally with respect to the stamping station to apply selected transfers from the transfer sheet to the packages in the carton, and the stop is adjustable with respect to the platen to apply the transfers to selected locations on the package.

43 Claims, 18 Drawing Figures

| FIG. 13A | FIG. 13B |
|---|---|

TRANSFER APPLYING MACHINE

BACKGROUND OF THE INVENTION

The present invention relates generally to the art of applying a plurality of transfers simultaneously to a plurality of packages, and more particularly to the application of tax stamps, labels, ink imprints, or the like to individual packages of cigarettes in a carton without removing the packages from the carton.

The tax revenue on the sale of cigarettes has become a major source of income for many states and local governments which, to insure payment of the appropriate taxes, require that revenue stamps or transfers be applied to each package of cigarettes before that package is sold at a retail outlet to the general public. The required tax stamps or transfers are usually mounted on long sheets or webs in the form of rolls which are then sold by the state or local government to the wholesale distributors of the cigarettes. The distributors must then open the cartons in which the cigarette packages are normally enclosed by the manufacturer and the tax stamps or transfers must then be applied from the supply sheet to each package in the carton. The carton must then be reclosed and resealed for distribution to retail outlets.

Because the tax stamps are purchased by the roll, it is important to the distributor that each stamp on the roll be properly applied to the cigarette package so that stamps are not wasted. This means that they must be accurately positioned on the ends of the cigarette packages and, in order to avoid high labor costs, this must be done as rapidly as possible. A large number of machines have been devised for expediting this process, and such machines have provided substantial savings over the costs of manually applying the tax stamps or transfers, and thus have been highly successful. These machines have been designed to handle one or the other of the two basic processes which have evolved and which are now principally used in the application of tax stamps to cigarette packages; namely, the wet ink process, and the decalcomania transfer process. Thus, many of the presently available machines transfer the required imprinting to the cigarette packages by a wet ink process, wherein a desired pattern is printed on each package by means of a suitable inked printing head or by means of an inked transfer sheet, while other machines utilize decals or transferable patterns which are mounted on a backing sheet and which may be transferred to the cigarette packages through the application of heat or a solvent such as water. Although the present invention is equally applicable to ink-type stamping machines, its principle application is to the decal-type of transfer stamp, and will be described with respect thereto.

The decal process, as presently in use in the industry, utilizes a backing sheet with a plurality of transfers, which may be referred to herein as tax stamps, mounted thereon. The stamps are mounted in lateral rows of fifteen and are spaced approximately $\frac{3}{4}$ of an inch apart, center to center. A multiplicity of rows extend the length of the sheet, the stamps in adjacent rows also being spaced center to center by about $\frac{3}{4}$ inch. These sheets are supplied in rolls and in a stamp applying machine, the rolls are advanced to expose pairs of rows of stamps to the transfer mechanism thereof for transferring selected stamps to corresponding packages of cigarettes. Since each carton of cigarettes contains 10 packages, five in each of two rows, only one-third of the stamps in each row of stamps are transferred to the packages in a given carton, and two adjacent rows therefore contain enough tax stamps for three cartons of cigarettes. The arrangement of these sheets and their manner of application to successive cartons of conventional cigarette packages are illustrated, for example, in U.S. Pat. No. 3,513,616 to Davis, and in particular FIG. 12 thereof.

Decal sheets and the machines for using them have been standard for many years. Such machines typically provide a mechanism for advancing the carton through an opener station where the carton is opened, through a stamping station where the required tax stamp or indicia is applied, and finally through a reclosing station where the carton is closed and sealed. The variety of machines available for this purpose is illustrated by the teachings of U.S. Pat. Nos. 2,516,783 to Matter, 2,216,884 to Kott, 2,574,087 to Burhans, 2,595,122 to Burhans, 3,121,300 to Rossi, and by many others. Each of these patents discloses a mechanism for opening and resealing cartons of cigarettes and for applying a tax stamp of some kind to the packages while the carton is open.

Many of the machines developed in this art, particularly those produced in the earlier years, were designed to accommodate a single size of carton having cigarette packages of a standard size, for virtually all cigarettes sold were of a single size and were wrapped in standard packages. When the "king" size and "imperial" size cigarettes were introduced, it was found that many of the earlier machines could not handle them, and it became necessary to modify the machines or to replace them if manual application of the stamps was to be avoided. Later machines, therefore, were produced to accommodate these larger cigarette package sizes, and were made adjustable to permit the machine to selectively handle the various sizes available on the market. Such a machine is illustrated in U.S. Pat. No. 3,513,616 to Davis, mentioned above. However, the design changes in these machines were made principally to enable them to handle cigarettes of various lengths, the remaining dimensions of the cigarettes, and thus of the packages, remaining essentially unchanged and requiring no modifications.

The machines of the prior art generally required that the cigarette cartons be disposed so that the packages of cigarettes were upright, and adapting them to accommodate longer lengths involved very substantial modifications in the machines, since such accommodation generally required changing the vertical distance between the conveyor mechanism and the stamp applying mechanism. Many machines were stretched to their limit of adaptability by the king sized cigarettes, which are approximately 100 millimeters long. Since the width and depth of each cigarette package remained essentially unchanged for king-size cigarettes, however, it was unnecessary to modify the tax stamping mechanism for such machines.

With the advent of the hard box packing for cigarettes, and with the advent of hard filters, the requirements for package dimensions changed slightly, the ends of the new package being slightly wider and slightly deeper than the standard $2\frac{1}{8} \times 7\frac{7}{8}$ inch packages. This small change in dimension did not seriously affect the operation of prior machines since the overall size of a carton did not change sufficiently to remove the packages from the range of the tax stamp applying mechanism, although with these new packages the stamps were no longer uniformly positioned on the ends of all of the packages in a carton. Thus, the prior art machines have been able to accommodate to many of the previous changes in cigarette styles without encountering significant difficulty, and various improvements have been made to increase the speed of operation of such machines so that satisfactory performance has been maintained. However, because such machines had been constructed to handle cigarette cartons in a specified way, they had only limited adjustability, and that limitation prevented such machines from being adapted to the most recent evolutions in cigarette styles.

The recently introduced extra long cigarettes, which are 120 millimeters or more long, are also slimmer than prior cigarettes, and result in a package which is considerably narrower than the standard size, although its depth is approximately the same. Thus, the dimensions of the ends of the packages are 1 13/16×13/16 inch as opposed to the $2\frac{1}{8}\times\frac{7}{8}$ inch size of the standard package. When these new cigarettes are packaged in a carton of ten in the conventional manner, the length of the carton is reduced by almost an inch, and such cartons cannot be accepted in the old style stamp applying machines. Not only are the cigarettes too long to fit into most of the machines, but the smaller dimensions of the package ends, where the stamps are to be applied, prevents the packages from being aligned by the conventional machines with the tax stamps on a standard roll of stamps. Thus, for example, where a standard carton top or bottom might measure $10\frac{3}{4}$ inches$\times 1\frac{7}{8}$ inches, the new 120 millimeter cigarette cartons measure approximately 9 5/16 inch$\times 1\frac{5}{8}$ inch. Since this difference in length is greater than the distance between adjacent stamps on a decal roll, it has not been possible to utilize conventional machines for the application of stamps to these cigarette packages. Thus, it has been necessary either to place the stamps on the packages by hand, an extremely expensive procedure as compared to the usual machine operation, or to incorporate spacers in the cartons to separate the packages, again an expensive procedure which is wasteful of material and which adds an additional complication to the packaging methods used at the factory.

Because the 120 millimeter length cigarettes had only a small share of the overall cigarette market, it was not economical for machine manufacturers to rebuild their machines to the smaller scale required for the smaller package dimensions or for the manufacturer of the decal sheets to change the arrangement of the tax stamps on the rolls. Further, since the application of stamps is normally a job that is performed by small distributors or jobbers in small, local areas, the cost of any new machines required to handle such small quantities of cigarettes could not be justified economically. These difficulties were overcome, however, by the tax stamp applying machine described and claimed in U.S. patent application Ser. No. 678,263 of Max Norris Baker and Julian Martin, filed on Apr. 19, 1976 and entitled "Machine for Applying Transfers", now U.S. Pat. No. 4,101,362, issued July 18, 1979, and assigned to the assignee of the present application.

The transfer applying machine of the copending application provided a unit in which cartons of cigarettes are advanced sequentially through an opening station, a stamping station, and a closing station formed along a guide chute, the chute being adjustable to accommodate all lengths of cigarettes. The cartons are placed in the chute with the packages lying on their sides, so that the ends to which the stamps or transfers are to be applied are in a generally vertical plane. A transfer sheet is located adjacent the guide chute with two rows of transfers being aligned with the two rows of packages in the carton. A drive mechanism for the conveyor intermittently advances cartons in spaced relationship to the guide chute, each carton being halted at the stamping station long enough for the stamps or transfers to be applied. The conveyor is in the form of a drive chain which includes a plurality of spacer blocks which are selected as to size and/or position on the chain so as to properly position each carton in turn in alignment with the stamps which are to be applied from the transfer sheet when the chain stops. These blocks are secured at spaced locations along the chain and by utilizing various sizes, which may be replaceably secured to the drive chain, the location at which each carton in turn stops in the stamping station may be selected with great precision and without the need for adjusting the interconnection between the drive mechanism and the chain.

The transfer mechanism for the machine of the copending application includes a heated platen mounted for reciprocating motion in a horizontal plane toward and away from the exposed ends of the cigarette packages in the open cartons. When a carton is properly positioned for the transfer operation, the platen is moved forward into contact with the back surface of the decal sheet, the platen contacting the sheet at spaced areas corresponding to the location of the first set of transfers on the sheets and driving them into contact with the individual packages of cigarettes in the carton. The platen holds the transfer sheet in contact with the packages momentarily, allowing the tax stamps to be transferred, and then withdraws. The carton is then moved to the closing station, another carton is moved into the printing station, and the operation repeated. However, before a subsequent transfer is carried out, the platen is adjusted laterally to align with a second set of transfers on the sheet, and because of the small size of the packages, the position of the carton must be adjusted to correspond to this lateral motion and to align with the new packages with the second set. The spacer blocks accomplish this carton positioning so that the second set of transfers is properly located with respect to the cigarette packages. After three cartons or so are stamped, a first stamping cycle, wherein all of the transfers in the initial two rows of the sheet will have been applied, is complete, and the transfer sheet is advanced to position two more rows in the transfer station. A second cycle of operation follows, wherein the transfers of the second pair of rows are applied in sets, with the platen being adjusted laterally in the opposite direction for alignment with the appropriate sets, the platen returning to its initial position at the end of the second cycle. The machine then continues to operate repetitively through these two cycles.

Although the machine described in the copending application Ser. No. 678,263 solved many of the problems of the prior art and allowed the application of tax stamps to a wide variety of cigarette package sizes, nevertheless in the operation of that machine certain difficulties were encountered. In particular, it was found that the design of that machine unduly limited the speed at which tax stamps could be applied to the cigarette packages, for it was found that the extra step of tilting the cartons over on their sides prior to the opening and stamping operations imposed an additional step in the sequence of operation, and this additional step was found to be a limiting factor in the speed at which the device could operate. Further, it was found that the pusher blocks used in the conveyor imposed additional limits on the speed at which the device could operate, for it was found that if the machine was operated too fast, the inertia of the cartons as they were carried into the stamping station would carry them beyond the desired stopping point so that when the chain drive stopped, the cartons would not. This caused serious problems of alignment, particularly with some sizes of cigarette packages where the spacing was already critical. Further, although the use of replaceable blocks of different sizes permitted accurate adjustment of the machine for various sizes of cigarette packages, nevertheless, it was found that the changing of the machine from one size to another was time consuming and often required experimentation before an accurate setting could be obtained. Finally, it was found that the machine as described and constructed was too bulky for ease in handling and installation. The weight and size of the machine created serious difficulties.

SUMMARY OF THE INVENTION

It is an object of the present invention to provide a high speed, fully adjustable stamp applying machine for transferring stamps or other indicia from a sheet to a plurality of packages, and more particularly for applying tax stamps to the ends of cigarette packages contained in a two-by-five carton, where the packages may be of any size currently on the market, and where the machine is adaptable easily and quickly to any such size.

It is another object of the invention to provide an improved tax stamp applying machine which will accept any presently known two by five carton having any size cigarette packages, and which is adjustable to apply the stamps to a variety of packages, and wherein the machine can be quickly and easily adjusted to a variety of sizes with minimum down time, and which uses standard sized decal sheets for packages of any dimension.

A further object of the invention is to provide a transfer applying machine for placing tax stamps on cigarette packages, wherein the machine is adjustable to insure proper location of each carton in turn both with respect to the transfer sheet and with respect to the platen so that decals will be properly applied to the end of each package in the carton, the mechanism being easily adjustable to insure operation with all sizes of cigarette packages now on the market, and with sufficient flexibility to enable it to adapt to additional sizes should they become commercially desirable.

It is another object of the invention to provide a transfer applying machine for placing tax stamps on the ends of cigarette packages at a high rate of speed and with a minimum handling of the cartons, and which will insure accurate alignment of the carton with the stamps to be applied.

It is a further object of the present invention to provide an improved tax stamp applying machine which is easily adjustable, inexpensive, simple to operate, and which is less bulky and thus easier to handle than prior machines.

Briefly, the transfer applying apparatus of the present invention is a three-part machine which includes an opener station, a transfer applying, or stamping, station, and a closure station, and means for conveying cigarette cartons through these three stations. The apparatus is constructed in a modular arrangement so that each of the stations is a self-contained and separable module, but where the three sections may be joined together and operated in synchronism from a common power source so that they function as a unitary machine. As will be explained, the three portions of the machine cooperate to provide a high speed operation in which cigarette cartons are fed first to the opener station, where the cartons are opened along one side to expose the ends of the cigarette packages. The opened carton is then conveyed to the stamping station where each carton is momentarily stopped and a tax stamp placed on each package. Finally, the carton is released and is conveyed to the closure station where the carton is resealed and delivered to a conveyor for further processing as required. The machine is relatively easy to handle in its disassembled modular form, may be assembled in minimum time, and when complete provides high speed and accurate placement of tax stamps on cigarette packages of any size that is compatible with the arrangement of the tax on the sheets or webs supplied by the stamp manufacturer.

The carton opener station, or module, includes a loading conveyor by which cartons to be stamped are fed to the machine one at a time. The cartons are picked up by a suitable conveyor and carried through a conventional carton plow which unseals and opens the flaps which are folded over the end of the cigarettes to which the stamps are to be applied, and which forms one elongated side wall of the carton. To facilitate this operation, in one form of the invention the top corners of the carton are gripped by a pair of opposed rollers which squeeze the carton inwardly and slightly downwardly, causing the flaps that are to be opened to bulge upwardly and to thereby facilitate entry of the plow. The plow then opens the flaps and spreads them apart as the carton is carried toward the stamping station. The conveyor for this portion of the machine may be a drive chain with a plurality of spaced pusher bars or paddles which contact the cartons being fed by the supply conveyor and carry them one at a time in spaced relationship through the opening plow. Thus, the cartons are fed sequentially and in spaced relationship to the next part of the machine, which is the stamping station.

The stamping station, or module, receives the opened cartons, and by means of a suitable conveyor carries each carton to a specific and predetermined location where it is momentarily stopped while the tax stamps are applied to the packages therein. The conveyor for the stamping station comprises, in its preferred form, a pair of drive belts which extend the length of the carton path through the station, with the positioning and momentary stopping of each carton being accomplished by an intermittently operated mechanical stop which extends into the carton path. Each carton is stopped in alignment with predetermined tax stamps located on a web or sheet of stamps mounted on the machine adjacent the path of the carton. A heated platen is depressed during the period when the carton has stopped, pressing the selected tax stamps against corresponding package ends and effecting transfer thereof. After the platen is withdrawn from the cigarette packages, the stop mechanism is activated to allow the carton to be carried out of the transfer station. The location of the platen is then adjusted to bring it into alignment with the next set of stamps that is to be applied to the next corresponding carton and, after passage of the first carton from the stamping station, the stop returns to its closed position to halt the next carton, at which time the stamp application process is repeated.

To insure that each carton is properly aligned with the platen so that the corresponding tax stamps carried by the web will be properly positioned on each package in the carton, the mechanical stop mechanism is movable with the platen so that each time the platen moves longitudinally to a position aligned with stamps to be applied, the stop moves with it to insure that the next received carton is aligned with both the platen and the stamps to be applied. In the present invention, this movement of the mechanical stop is accomplished by mounting the stop of the platen mechanism so that there is a positive mechanical relationship between the location of the platen and that of the stop. This insures accurate alignment of the carton with respect to the platen, and insures precise placement of the tax stamps.

To accommodate the machine to a variety of package sizes, and thus to permit adjustment to various carton dimensions, the relative positions of the platen and the stop mechanism are also made adjustable. In the preferred form, the stop is adjustably secured to the platen so that its position with respect to the longitudinal length of the platen may be varied and in this manner the exact location of the packages may be adjusted so that they are properly positioned to receive the transfer stamps. This adjustability permits the stamping station to be adjusted for a given carton and package dimension or to permit adjustment of the particular location of a stamp on a package. This latter adjustment is of value not only when different size packages are fed through the machine, but also when several stamps are to be placed on a particular package. In this latter case, the stopping point of each carton may be adjusted with respect to the platen so that the stamp being applied is secured to a particular point on each package, so that a number of stamps, for example, federal, state and local stamps, may be placed on each package without overlap.

The stop mechanism used with the present invention provides a positive limitation to the motion of the carton as it is carried through the transfer-applying station, and thus insures alignment accuracy. However, since the cartons are traveling at a high rate of speed, the positive mechanical stop could cause rebound of the packages if it were not for the provision of a conveyor having continuously operating drive belts which carry the packages through the station. The cartons typically have a relatively slick surface, and the drive belts are spring loaded against the sides of the cartons to insure a positive drive and an even flow of cartons through the unit. However, the spring loading also allows slippage when the cartons have been stopped for application of the stamps, and this continuous drive prevents rebound. In addition, the spring loading of the drive belts against the sides of the carton assures centering of the cartons, even for a variety of sizes, thus further assisting in the proper alignment of the stamps on each package.

As the cartons travel through the stamping station, they are supported by a vertically adjustable platform which provides a smooth surface for the cartons to travel on, and which permits adjustment of the unit to accommodate a variety of package heights. By providing a bottom plate which is vertically adjustable, the stamp transfer mechanism, including the platen and the transfer sheet, need not be vertically adjustable, and this simplifies the construction and operation of the machine. The bottom support plate is easily adjusted by a hand wheel to permit the operator to position the tops of the packages with respect to the downward motion of the platen so that the proper stamp transfer operation can be carried out. It will be noted that the platen is spring biased downwardly so that the transfer operation is spring-driven rather than being driven by a cam or other positive mechanical linkage. This allows the platen to accommodate to small variations in the location of the top surface of the cartons so that slight misadjustments of the bottom support plate, or small variations in the height of the packages will not affect the transfer operation significantly. The platen is retracted by cam operation to provide a positive release of the carton when the transfer is complete and the carton is to be carried out of the stamping station.

Upon release of the platen and opening of the stop mechanism, the carton is carried out of the stamping station by the continuously driven drive belts and is thrust into the closure station module. A conveyor mechanism grasps the carton and carries it through a glueing station, where a suitable adhesive is applied to one of the carton flaps. The conveyor then carries the carton through a conventional closure plow which folds the flaps back over the packages to seal the carton. The closed carton is then delivered to an unloading conveyor which carries the cartons to a loading platform where they may be loaded in boxes or otherwise further treated.

The cartons travel through the assembly of the present invention in an upright position for faster handling than was available with the prior machine. Further, processing in the upright position allows visual monitoring of the packages so that an operator can shut the system down or provide needed adjustments if improper operation is observed. This machine differs from many in the prior art in this regard, however, for it is provided with a vertical adjustment feature which allows it to receive a wide variety of package sizes to which prior machines could not be accommodated. This improved arrangement has been found to overcome the difficulties encountered with prior art transfer machines, and thus provides a faster, more accurate, and more flexible tax stamp transfer machine than has previously been available. The simplicity of the machine allows easy adjustability, assembly, disassembly, and maintenance, and results in a less expensive and thus more desirable product.

BRIEF DESCRIPTION OF THE DRAWINGS

The foregoing and additional objects, features and advantages of the present invention will become apparent from a consideration of the following detailed description of a preferred embodiment thereof taken in conjunction with the accompanying drawings, in which.

DESCRIPTION OF A PREFERRED EMBODIMENT

Figure 1:
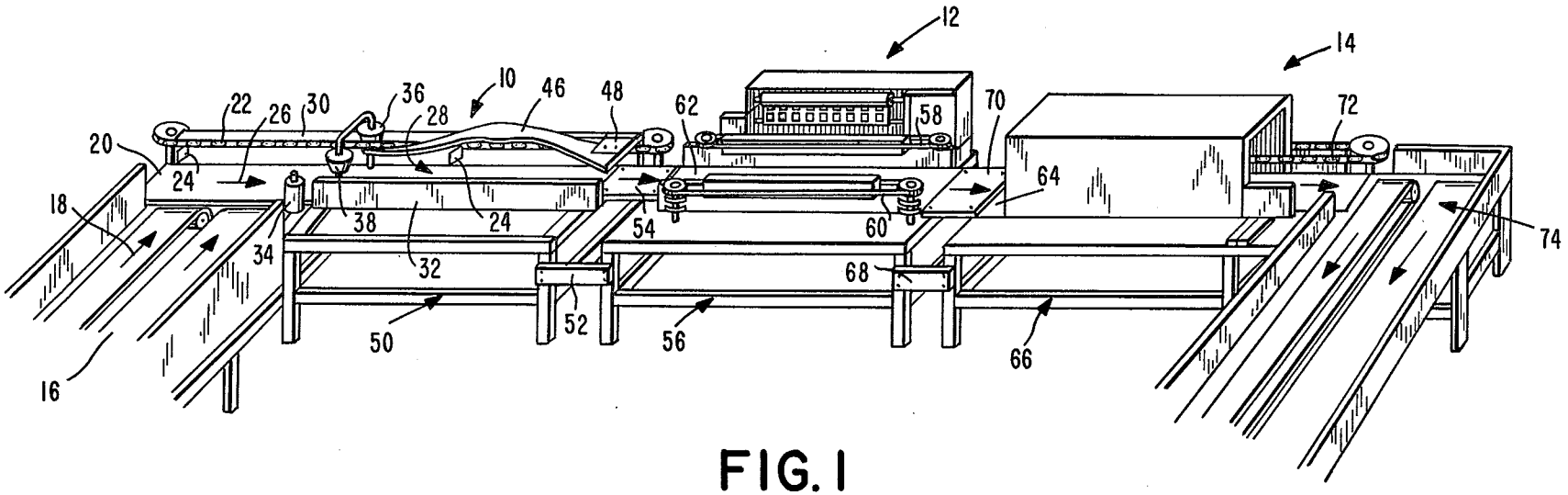
FIG. 1 is a diagrammatic illustration in perspective of a modular tax stamp applicator assembly constructed in accordance with the present invention.

Turning now to a more detailed consideration of the drawings, there is illustrated in FIG. 1 a tax stamp applicator assembly which includes a carton opener section 10, a stamping section 12 and a carton resealing or closure section 14. These three sections are preferably constructed in the form of separable modules for ease of construction, handling and maintenance, and to permit each section to be sold as a separate, self-contained unit. These modules, which reduce the bulk and weight of the apparatus, making it easier to ship and to install, cooperate to produce a unitary, synchronized stamp applying machine when assembled.

Figure 2:
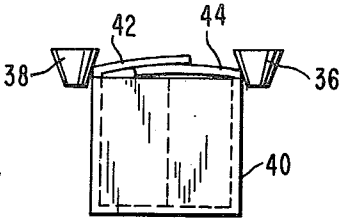
FIG. 2 is a diagrammatic illustration of a portion of the opener section of the assembly of FIG. 1.

The opener section 10 includes a loading conveyor 16 which receives cigarette cartons that are to be stamped and feeds them laterally in the direction of arrow 18 to a table or platform 20. The machine operator places the cartons of cigarettes in their upright position, i.e., with the ends of the packages facing upwardly, across the loading conveyor 16 which carries them to platform 20 where they are picked up one at a time by a drive chain 22. The drive chain carries a plurality of spaced feeder paddles 24 which engage the cartons one at a time and carry them longitudinally along the platform 20 in the direction of arrow 26. The drive chain carries each carton in turn through an opening station 28 defined by the platform 20 and side walls 30 and 32, a roller 34 being provided at the end of wall 32 to guide the cartons into the opening station. As the cartons move lengthwise into the opening station, they pass between a pair of squeeze rollers 36 and 38 which are resiliently mounted and which press inwardly and downwardly against the top opposite edges of each carton. As illustrated in FIG. 2, the pressure exerted by rollers 36 and 38 against the carton 40 tends to bow the top closure flaps 42 and 44 away from the tops of the cigarette packages carried in the carton, the taper of the rollers being such that they produce sufficient downward pressure to hold the packages down in the carton.

As the carton is advanced through rollers 36 and 38 and along the length of the opener section by drive chain 22, a carton opener plow 46 engages the space between the closure flaps and the tops of the packages and forces the flaps 42 and 44 upwardly and apart, folding them over so that they extend horizontally outwardly from the carton to expose the end surfaces of all of the packages of cigarettes within the carton. The plow may be supported on wall 30, for example, by a bracket 48. When the carton reaches the right hand end of the opener station, as viewed in FIG. 1, the carton is completely open with all of the packages exposed and ready for the application of suitable tax stamps or the like.

As a matter of convenience, the opener station 10 may be mounted on a suitable support frame generally indicated at 50 which may be connected by means such as connecting plates or brackets 52 and 54 to a similar support frame 56 which carries the stamping section 12 of the assembly. The stamping section incorporates means for applying tax stamps to the ends of each cigarette packages contained in a carton, the cartons being driven through the station by a suitable conveyor mechanism such as continuously operating drive belts 58 and 60 along a support platform 62. A stop assembly (not shown) halts each carton momentarily in its passage through the applicator station to permit application of the tax stamps by a suitable platen assembly and the carton is then released and carried by the drive belts out of the stamping section, as will be described in greater detail below.

The stamped cartons are fed from the support platform 62 of the stamping section to a corresponding support platform 64 of the adjacent closure section 14 which is supported by a frame 66 secured to and aligned with the applicator section 12 as by means of brackets 68 and 70. The closure section 14 includes a conventional adhesive applicator which applies a suitable glue to one flap of the carton, and a closure plow which folds the two flaps over the now-stamped packages to reclose and reseal the carton. The details of this mechanism are not illustrated in FIG. 1, since such closure devices are conventional in the art. The cartons are drawn through the closure apparatus by a suitable conveyor mechanism such as a drive chain 72 which deposits the cartons one at a time on an unloading conveyor indicated at 74. This latter conveyor delivers the cartons to a repackaging station where they may be packed in suitable boxes, or may lead to other suitable handling stations, as desired.

The modular sections of the stamp applying apparatus of the present invention, as illustrated in FIG. 1, are preferably driven from a single electric drive motor connected to the various conveyors by means of suitable drive chains or drive shafts mounted to the support frame members 50, 56 and 66. Interconnecting the modular units by drive chains or belts permits easy assembly and disassembly of the units, and by using a single drive source the three sections are maintained in the desired synchronism with a minimum of control circuitry.

Figure 3:
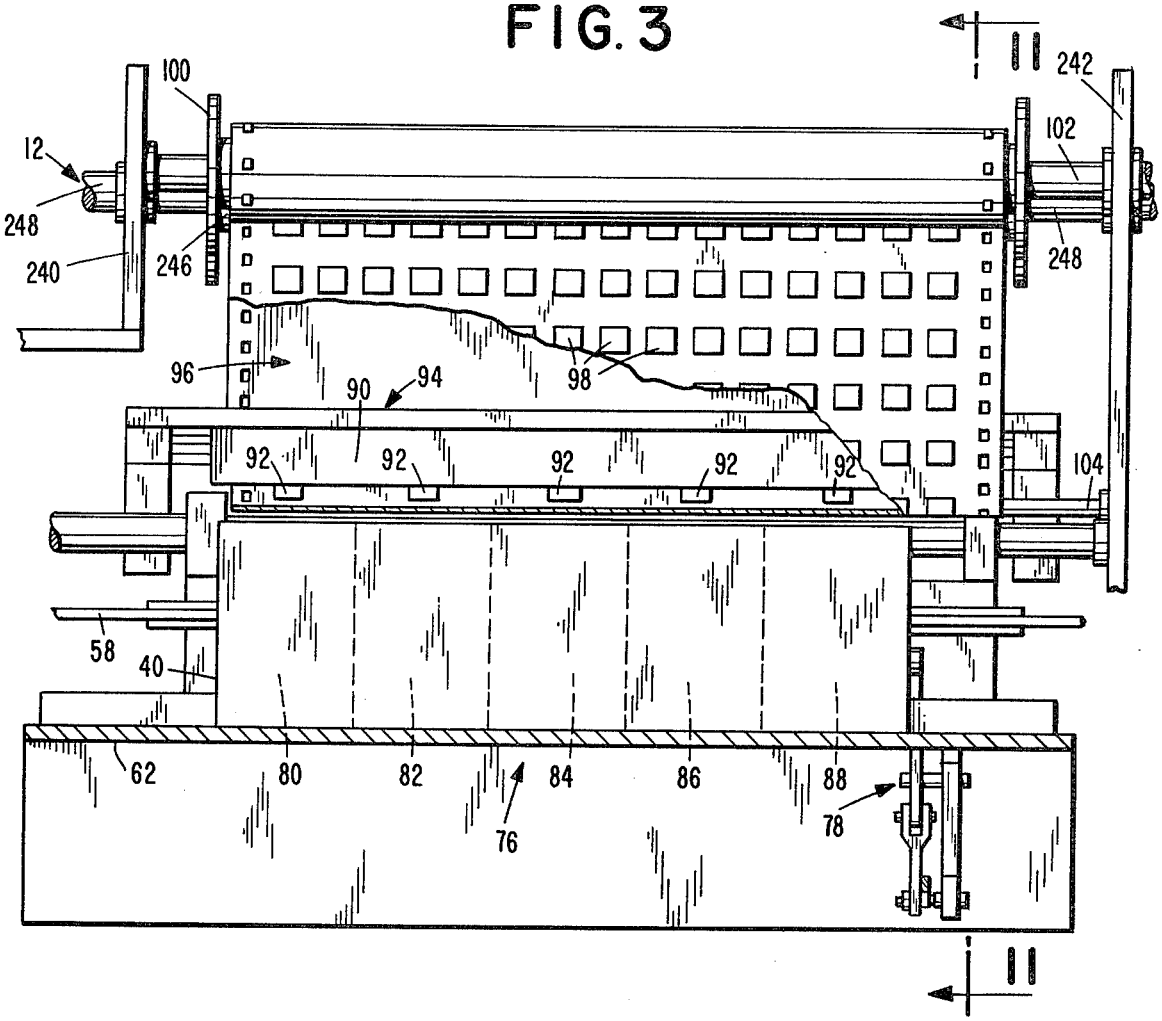
FIG. 3 is a front plan view in partial section of the stamping section of the apparatus of FIG. 1.
Figure 4:
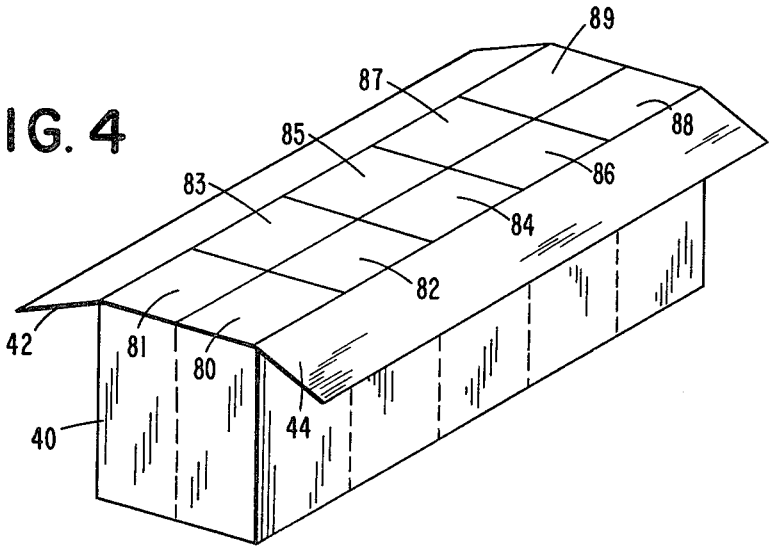
FIG. 4 is a perspective view of a carton containing a plurality of cigarette packages.

The stamping section 12 is illustrated in greater detail in FIG. 3, which is a partial sectional front view of the section and illustrates in diagrammatic form the major functions of the stamp applying mechanism. In this figure, the applicator is shown with a carton 40 of cigarette packages located at a stamp-applying, or transfer, station generally indicated at 76. This station is defined at its bottom by the vertically adjustable support platform 62 which carries the carton, and at its sides by the drive belts 58 and 60, only one of which is illustrated in FIG. 3. The specific location of the transfer station 76 within the applicator is defined by a stop assembly generally indicated at 78 which extends into the path along which the carton is moved by drive belts 58 and 60. This stop assembly halts the carton at a specifically defined location so that the tax stamps may be applied to the tops of packages contained within the carton. As may be seen in FIG. 4, the carton contains 10 cigarette packages 80–89, with five packages in each of two rows extending the length of the carton. The carton is fed longitudinally along the length of support platform 62 by the drive belts, and the stop assembly 78 positions the carton at a selected location with respect to a movable platen 90. The platen carries ten heating elements 92 formed in two rows of five each, the heating elements being spaced about 2¼ inches center to center longitudinally along the length of the platen in each row, with adjacent rows being spaced by about ¾ of an inch. This spacing of the platen heating elements generally correspond to the spacing of the standard cigarette packages in a conventional carton so that when a standard carton is aligned with platen 90 as illustrated in FIG. 3, each heating element 92 will strike the approximate center of the top of each corresponding package.

Platen 90 is mounted on a pivotally mounted stamping frame 94 so that the platen elements may be moved vertically toward and away from contact with the cigarette package ends. Interposed between the heating elements 92 and the ends of the cigarette packages is a transfer sheet 96 on which is mounted on the transfers, decals, or other indicia such as tax stamps which are to be placed on the packages. As illustrated in this figure, the transfers, which in the usual form of the invention take the form of tax stamps 98, are secured to the backing sheet in rows of 15 extending transversely across the width of the sheet, the distance between the centers of adjacent stamps in the commercial form of the sheets being about ¾ of an inch with adjacent transverse rows also being spaced along the length of the sheet by ¾ of an inch. The transfer sheet, which is supplied in its commercial form on a roll 100, is supported on a mounting shaft 102 and is fed down around a spacing bar 104 and laterally across the stamp applying station 76 of the stamp applicator section. The transfer sheet passes around a second spacing bar, not shown in FIG. 3, and is returned to a wind up reel. Means are provided to advance the transfer sheet from the supply roll 100 to the wind up reel and to position the tax stamps horizontally over the stamp applying station in such a position that vertical motion of the platen 90 will press the stamps against the cigarette packages for transfer thereto.

Because the spacing of the tax stamps on the transfer sheet was designed initially to accommodate standard size cigarette packages and cartons, the ten heating elements on the platen are positioned to coincide with ten transfer stamps on two adjacent rows of the transfer sheet so that when the platen is depressed, the ten tax stamps will simultaneously be applied to the ten packages in carton 40. The spacing of the platen elements insures that from the two rows aligned in the stamp applying station, only every third tax stamp in each of the two rows (i.e., one set of stamps) will be transferred in a given operation of the platen. Upon application of the stamps to a given carton, the platen is withdrawn, the carton moved out of the transfer station and a new carton moved into that station for the next application. However, it is necessary to adjust the position of the platen with respect to the transfer sheet in order to effect this next transfer, and accordingly in the preferred embodiment, the platen 90 is shifted laterally with respect to the transfer sheet in order to align the heating elements 92 with the next set of transfer stamps in the two selected rows. With a standard size carton of cigarettes, this adjustment of the platen may require no realignment of the carton within the transfer station, for each cigarette package is large enough to receive the tax stamp from the shifted location of the platen, although the tax stamp would not be placed in the same location on the cigarette package as with the first set. In similar manner, after application of the stamps to the second carton, the platen may be withdrawn and again shifted laterally with respect to the transfer sheet to apply a third set of tax stamps to a third carton. After transferring these three sets of tax transfer stamps to three cartons, the transfer sheet 96 is advanced to bring two fresh rows of stamps into alignment with the transfer station, and the process repeats, but with the platen being shifted in the opposite direction.

Although the foregoing operation is simple and effective with standard size cigarette packages, the advent of packages and cartons having smaller dimensions than the previously standard sizes created a series problem with the simple transfer arrangement described above, since the spacing of the transfer stamps no longer corresponded to those package and carton sizes. Accordingly, it has become necessary to shift the location of each carton as it is positioned in the transfer station so that it will be aligned with the set of tax stamps which it is to receive. To accomplish this, the stop assembly 78 is constructed as to be movable with respect to the transfer sheet so that each carton will be stopped in a specifically selected location that coresponds to and is aligned with the set of tax stamps which it is to receive, and with the position of the platen.

Movement of the stop assembly, in the preferred form of the invention to be described below, is obtained by connecting the stop assembly 78 to the platen or the stamping frame to which the platen is secured so that the stop assembly shifts laterally with respect to the transfer sheet with the corresponding motion of the platen. In this way the stop assembly precisely and positively positions the carton with respect to the platen and the selected set of transfer stamps to insure proper location of the stamps on each cigarette package. This operation is illustrated in diagrammatic form in FIGS. 5, 6 and 7.

Figure 5:
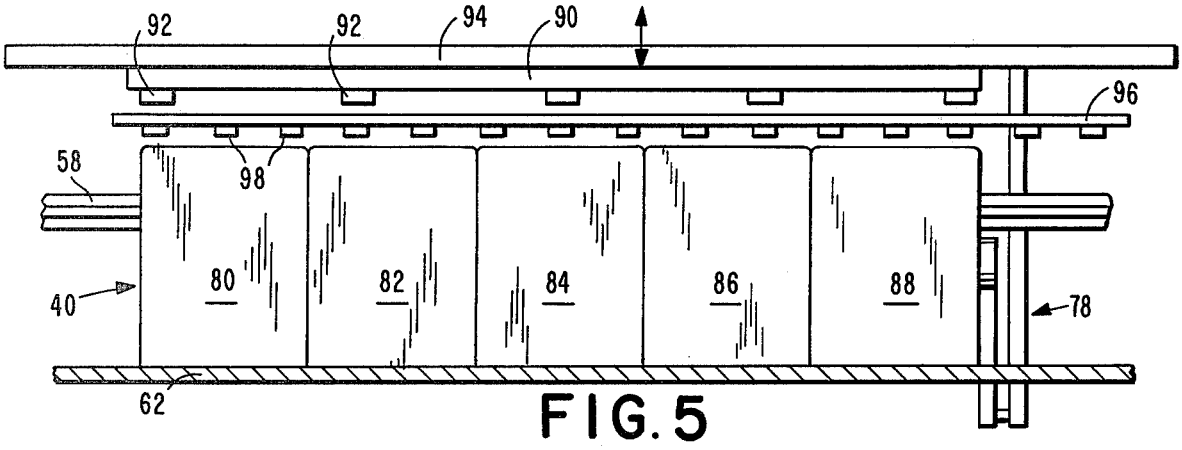
FIGS. 5, 6, and 7 are diagrammatic illustrations of the adjustability of the platen and stop mechanism with respect to the transfer sheet and indicate the effect of such adjustments on the placement of sets of transfers on the packages in a cigarette carton.

As may be seen in FIG. 5, a first carton 40 is positioned in the transfer station 76 at a first location with the heating elements 92 of platen 90 aligned with a first set of the tax stamps 98. In this case, the carton 40 includes non-standard package sizes so that the platens 92 do not line up with the centers of each of their corresponding packages; however, by proper adjustment of the stop element 78, the carton can be so positioned that one stamp will be applied to each package, although the stamps will be applied at different locations on the ends of the several packages in the carton. Upon proper alignment of the packages in the carton with the first set of transfers and with the heating elements of the platen, the platen is moved downwardly to press the corresponding tax stamps against the ends of the packages, one stamp being applied to each package.

In the preferred form of the invention, the transfer sheet comprises a paper web or base having a wax coating on which the tax stamps are printed. A thermoplastic adhesive layer is provided on the outer surface of the stamps or transfers so that when heat is applied to the back of the sheet as the transfer is pressed against a cigarette package, the wax will melt to release the transfer from the backing sheet and the adhesive will be activated to secure the stamp to the package. Accordingly, the platen is provided with suitable heating coils or the like to provide the required temperature for effective transfer of the stamps.

When the first set of stamps has been applied to carton 40, the platen is withdrawn, the stop assembly 78 is activated to release the carton, and the conveyor belts 58 and 70 carry the carton out of the transfer station toward the carton closure section. At the same time, the belts carry the next carton 40' into the transfer station, the platen 90 shifts laterally to align its heating elements with the second set of tax stamps on transfer sheet 96, and the stop assembly 78 shifts laterally to define the second stamp applying location within the transfer station. After the carton 40 has passed out of the transfer station, the stop assembly 78 recloses to block the second carton 40' which is then moved up against the stop element by the drive belts and is halted momentarily for the application of the second set of stamps.

Upon completion of the reciprocating motion of the platen 90, and consequent application of the second set of stamps, the process repeats, with the stop element being activated to allow carton 40' to be carried out of the transfer station, platen 90 shifting laterally to become aligned with the third set of transfer stamps, and a third carton 40'' being carried into position by the drive belts. Again, the stop assembly 78 is repositioned and closed to halt the third carton in the third location within the transfer station and the third set of stamps is applied. Carton 40'' is then released and a fourth carton moves into position. At the same time, the transfer sheet 96 is advanced to bring two fresh rows of stamps into the transfer station and upon positioning of the fourth carton (not shown) the platen is activated to apply a first set of stamps. The platen is then moved laterally back in the opposite direction to apply a second and then a third set of stamps from the transfer sheet to fifth and sixth cartons, the platen then being in its original location at the end of a complete cycle of operation.

Figure 6:
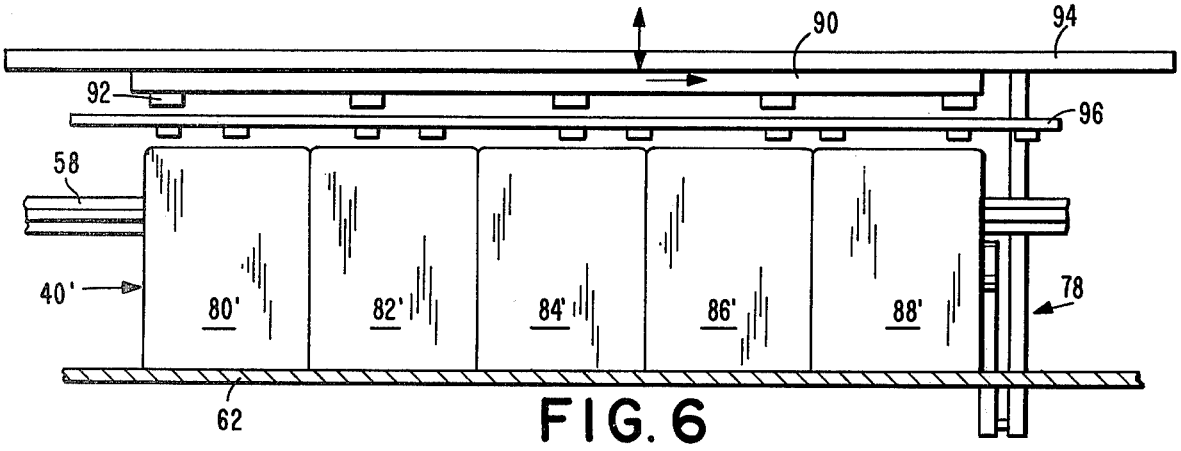
Figure 7:
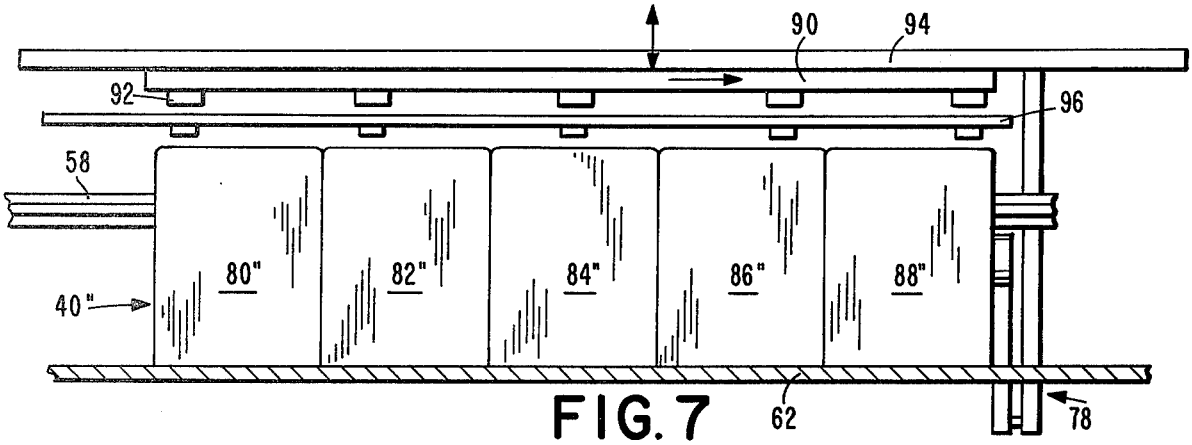

As has been indicated, the stop assembly 78 is, in accordance with the present invention, adjustable with respect to the platen 90 to permit adjustment of the location of the cigarette carton 40 with respect to the sets of stamps carried by the transfer sheet 96. This adjustability permits the machine of the present invention to accommodate a variety of cigarette package sizes by adjusting the specific location of the carton so that all five stamps of each set in each row will be applied to a correponding one of the five cigarette packages in a row within the carton. As indicated in FIG. 3, a standard size cigarette package provides no difficulties in this regard, since the spacing between the tax stamps on a transfer sheet is designed for such packages. However, as indicated in FIGS. 5–7, a smaller size cigarette package can present serious alignment problems and require very accurate location of the carton for each transfer operation, with the adjustability features of the present invention enabling the apparatus to apply stamps to the individual packages in cartons where the overall length of the carton is only slightly greater than the distance between the first and last stamps in a given set (see FIG. 5).

Figure 8:
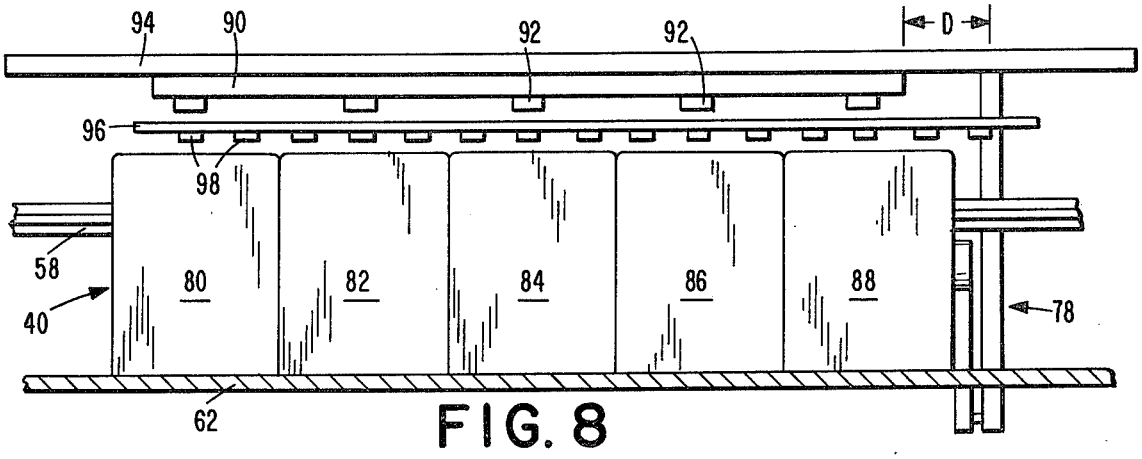
FIGS. 8, 9 and 10 illustrate in diagrammatic form the adjustability of the stop mechanism with respect to the platen and the effect of such adjustment on the positioning of a set of transfers on the packages in a carton.
Figure 9:
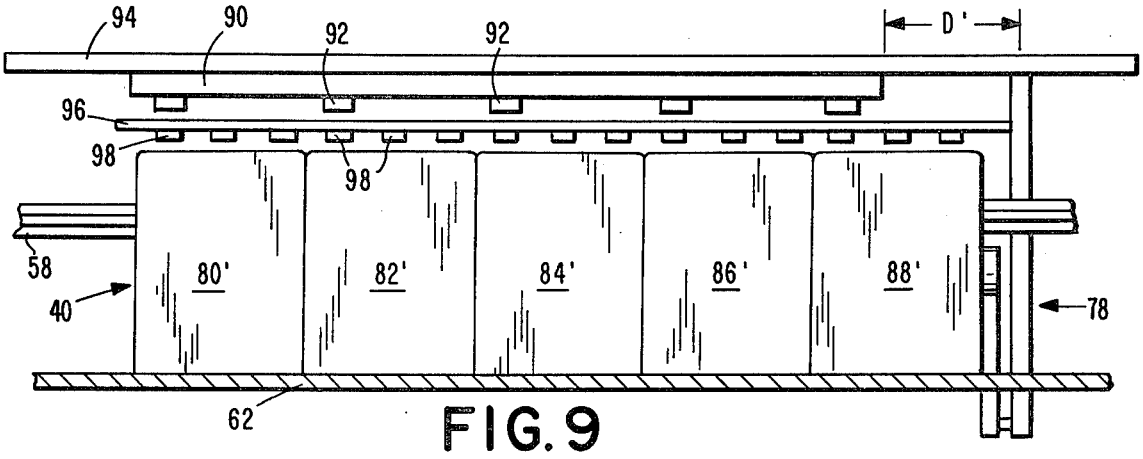
Figure 10:
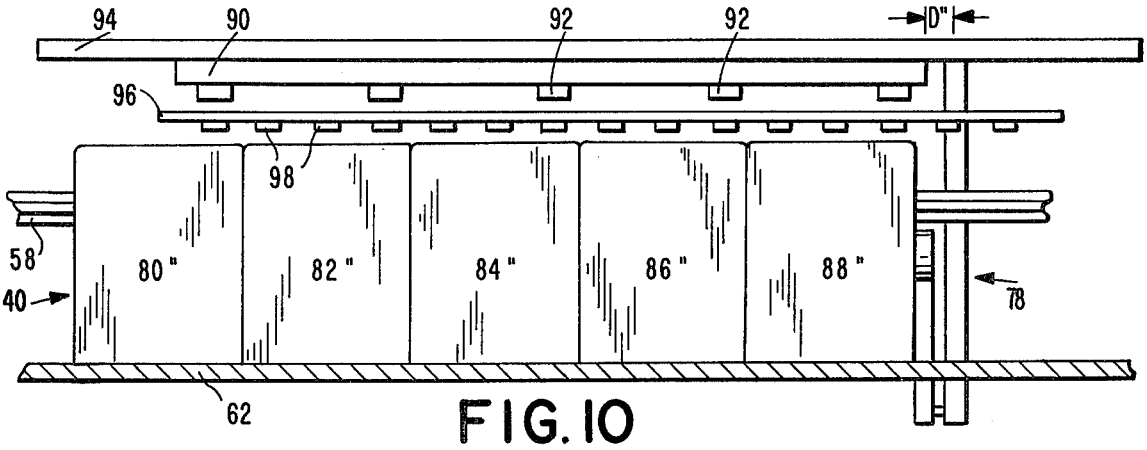

The range of variation available with the adjustable stop assembly of the present invention is illustrated in FIGS. 8, 9 and 10. In FIG. 8, the stop assembly 78 is illustrated at a middle location, located a distance "D" from plate 90, to position the heating elements 92 at the approximate centers of their corresponding packages within carton 40. As viewed in FIGS. 9 and 10, the stop assembly may be moved longitudinally away from platen 90 to a distance D', thereby halting the carton so that the platen 92 is aligned with the left hand edges of the corresponding cigarette packages or may be moved toward the platen to a closely adjacent position indicated at D'' so that the heating elements will be aligned with the right hand edges of the cigarette packages when the carton is stopped against the stop assembly. Once the stop assembly is adjusted with respect to the platen for a given size of cigarette cartons, the tax stamps may be applied in a continuous run, with the stop element being at a constant distance from the platen, but moving therewith to various locations within the transfer station to permit alignment of the packages with different sets of tax stamps, as illustrated in FIGS. 5, 6 and 7. As may be seen in those latter figures the stop element remains at a constant distance from the platen for a run of cartons of the same size, but may be adjusted in accordance with the variations illustrated in FIGS. 8, 9 and 10 when a different size carton is to be stamped, or when the location of a stamp on a package is to be changed.

In addition to permitting the application of transfers or stamps to a variety of package sizes, the adjustability of the stop element has the added advantage of permitting the application of a plurality of different stamps to a given package without overlap. Thus, as may be seen in FIGS. 8, 9 and 10, a single package may have two or more stamps applied in separate passes through the stamping machine, with the later stamps being positioned differently on the package ends so that there will be no overlap simply by changing the relative position of the stop element with respect to the platen. Thus, a first stamp can be applied in the center of the package, a second stamp at the left hand edge and a third stamp at the right hand edge simply by moving the stop assembly in the manner illustrated in FIGS. 8–10 for each of three passes of the carton through the stamping section of the machine. This is a real advantage where a plurality of different government entities require the application of tax stamps, permitting, for example, the application of federal, state and local tax stamps side by side on a single package end. It has been found that by careful positioning of the cartons in the various runs through the transfer applying machine, as many as five tax stamps can be applied to a single package.

Figure 11:
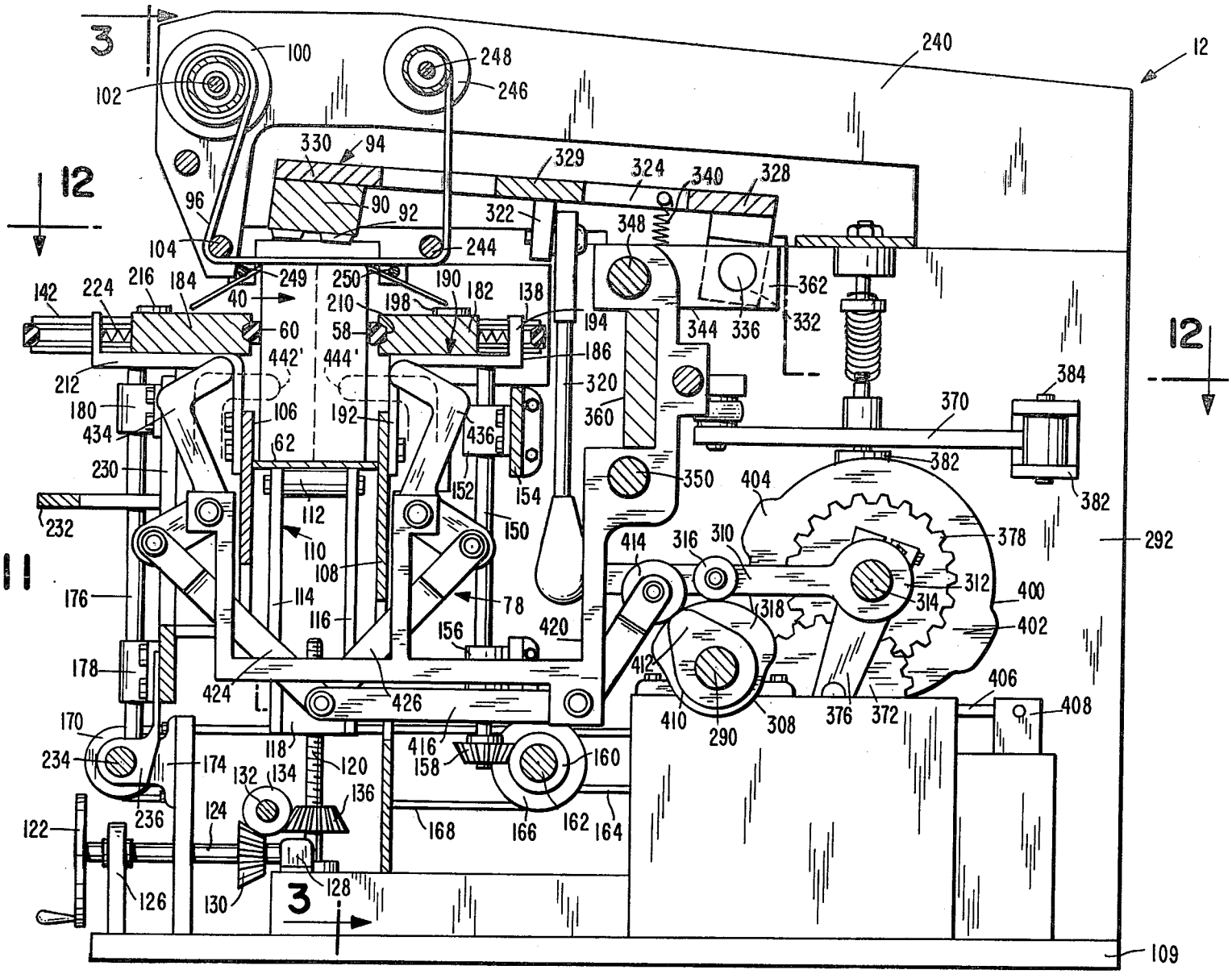
FIG. 11 is a cross sectional view of the stamping section of the modular assembly of the present invention, taken along lines 11—11 of FIG. 3.

The structural details of a preferred form of the invention which will provide the operational features discussed above are illustrated in detail in FIGS. 11–14, to which reference is now made. FIG. 11 is a cross-sectional side view of the stamping section 12 of the machine, taken along lines 11—11 of FIG. 3. In this figure, the machine is illustrated with a cigarette carton 40 in the transfer station at the completion of a transfer operation, and with the stop assembly activated to release the carton for transfer to the closure station. The carton is shown as resting on the support platform 62 which is vertically adjustable between guide walls 106 and 108 secured to the stamping section housing 109. The vertical motion of the support platform permits the machine to accommodate cartons containing cigarettes of varying lengths by insuring that the tops of the packages will be positioned just below the level of the transfer sheet 96 when the carton is in position for the transfer operation.

Any suitable adjustment mechanism may be provided for the support platform, but in the illustrated embodiment, a pair of lift brackets are provided, one at each end of platform 62. Only one of these brackets is illustrated in the sectional view of FIG. 11; lift bracket 110 is shown as having its upper end secured to the support platform by means of a fastening block 112. This bracket is secured by means of vertical arms 114 and 116 to a lower follower block 118 having a threaded hole which receives a vertical threaded shaft 120. This shaft may be rotated in one direction or the other to raise and lower the lift bracket and thus the support platform. Threaded shaft 120, and its companion (not shown) at the second of the pair of lift brackets located at the opposite end of the support platform, are driven by a hand crank 122 keyed to a shaft 124 which is mounted by means of suitable journals to the housing 109 of the machine. Shaft 124 carries a bevel gear 130 which drives a corresponding gear (not shown) mounted on an intermediate drive shaft 132. This shaft carries a pair of bevel gears, one of which is illustrated at 134 and which drives a corresponding bevel gear 136 mounted on threaded shaft 120. A similar arrangement drives the companion threaded shaft for the opposite end of the support platform. By means of this gear connection, rotation of hand crank 122 effects rotation of threaded shaft 120 in one direction or the other to raise or lower the support platform.

Carton 40 is driven along the guide channel defined by walls 106 and 108 and support platform 62 by means of the conveyor which preferably includes drive belts 58 and 60. Drive belt 58 is carried by a drive pulley 138 mounted at the entry end of the stamping section with its far end being carried by an idler pulley 140 located at the exit end of the stamping section. The drive belt thus includes a first, or inner, run which extends along but just above the guide channel for the cigarette cartons, as may be seen in FIGS. 11 and 12. In similar manner, the drive belt 60 is supported at the entry end of the guide channel by a drive pulley 142 and at the exit end by an idler pulley 144, these pulleys being so located as to position the inner run of the belt along, but just above, the guide channel on the opposite side thereof from belt 58.

The idler pulleys 140 and 144 are suitably mounted for rotation about vertical shafts 146 and 148 which may be secured in conventional manner to the machine frame, or housing, as by means of suitable bearing blocks (not shown). Drive pulley 138 is supported on a vertical drive shaft 150 supported adjacent its upper end by a bearing block 152 secured to a bracket 154 mounted on the machine frame. The lower end of shaft 150 similarly is supported by a suitable bearing block 156 and carries a bevel gear 158 which engages a corresponding gear 160 mounted on a horizontal drive shaft 162. This latter drive shaft is connected by way of a suitable pulley (not shown) and by a drive belt or chain 164 to a source of power such as an electric drive motor, as will be explained below. Shaft 162 also carries a pulley or sprocket 166 to drive, by way of a connecting belt or chain 168, a corresponding pulley or sprocket 170 mounted on a second horizontal drive shaft (not shown) supported on the machine frame by suitable means such as bearing block 174. This second shaft carries a bevel gear (not shown) by which it drives a vertical drive shaft 176, supported by bearing blocks 178 and 180, carrying at its upper end the drive pulley 142.

Drive pulleys 138 and 142, and thus the drive belts 58 and 60, are driven from a common source in synchronism to carry the carton 40 along the stamping section of the machine. These belts are continuously driven to urge the cartons continually through this section, while the stop assembly 78 operates intermittently to stop each carton at a preselected transfer location where it receives the tax stamps. The motion of the drive belts continues even when the carton is stopped to insure that the carton will be held against the stop assembly thus preventing rebound and insuring accurate positioning of the carton.

Figure 12A:
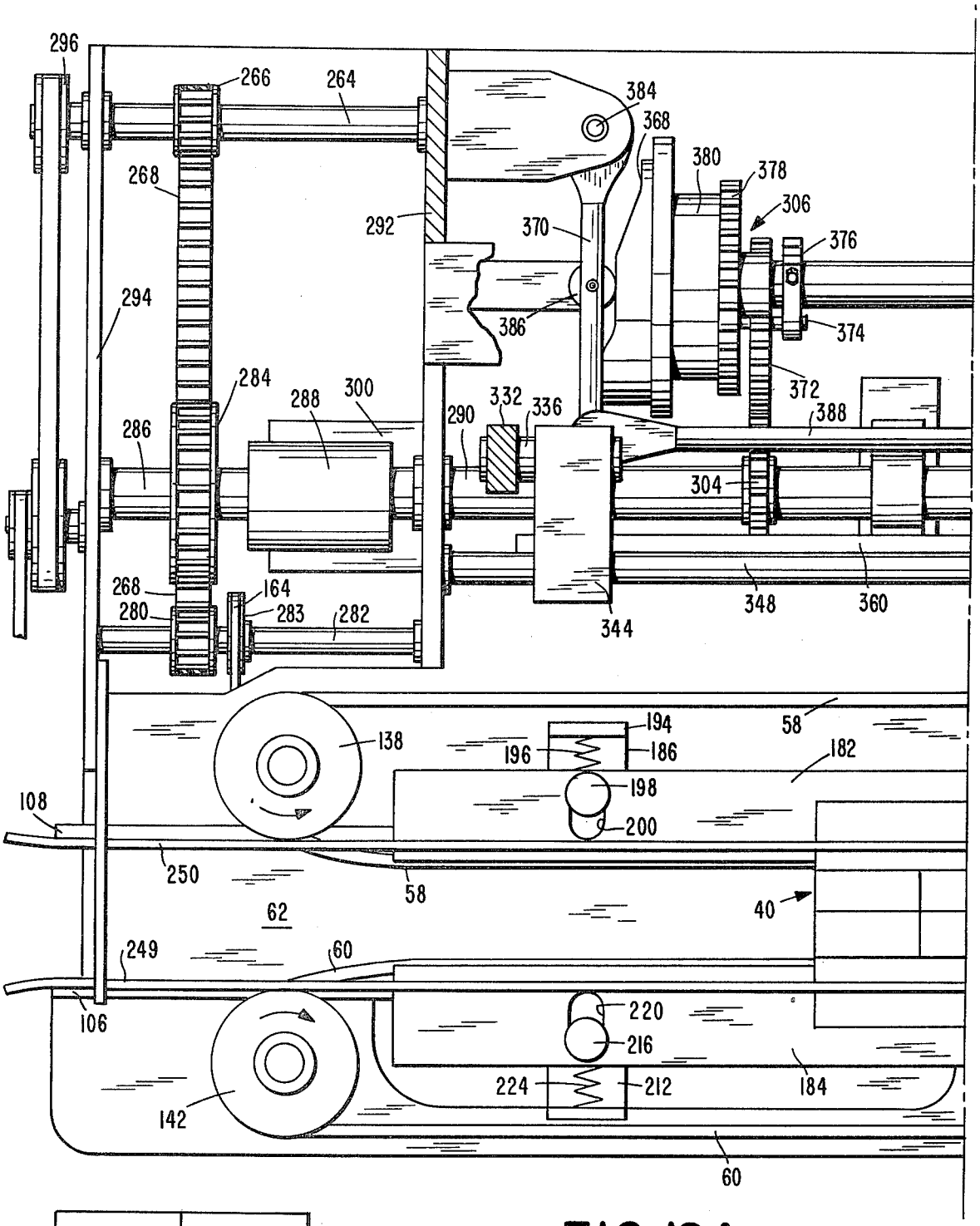
FIGS. 12A and 12B are a top sectional view of the stamping section, taken along line 12—12 of FIG. 11.
Figure 12:
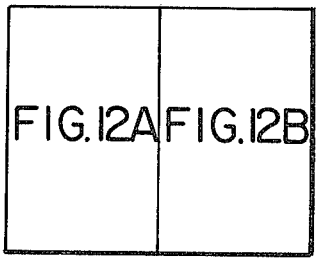
FIG. 12 illustrates the relationship of FIGS. 12A and 12B.
Figures 12B, 13:
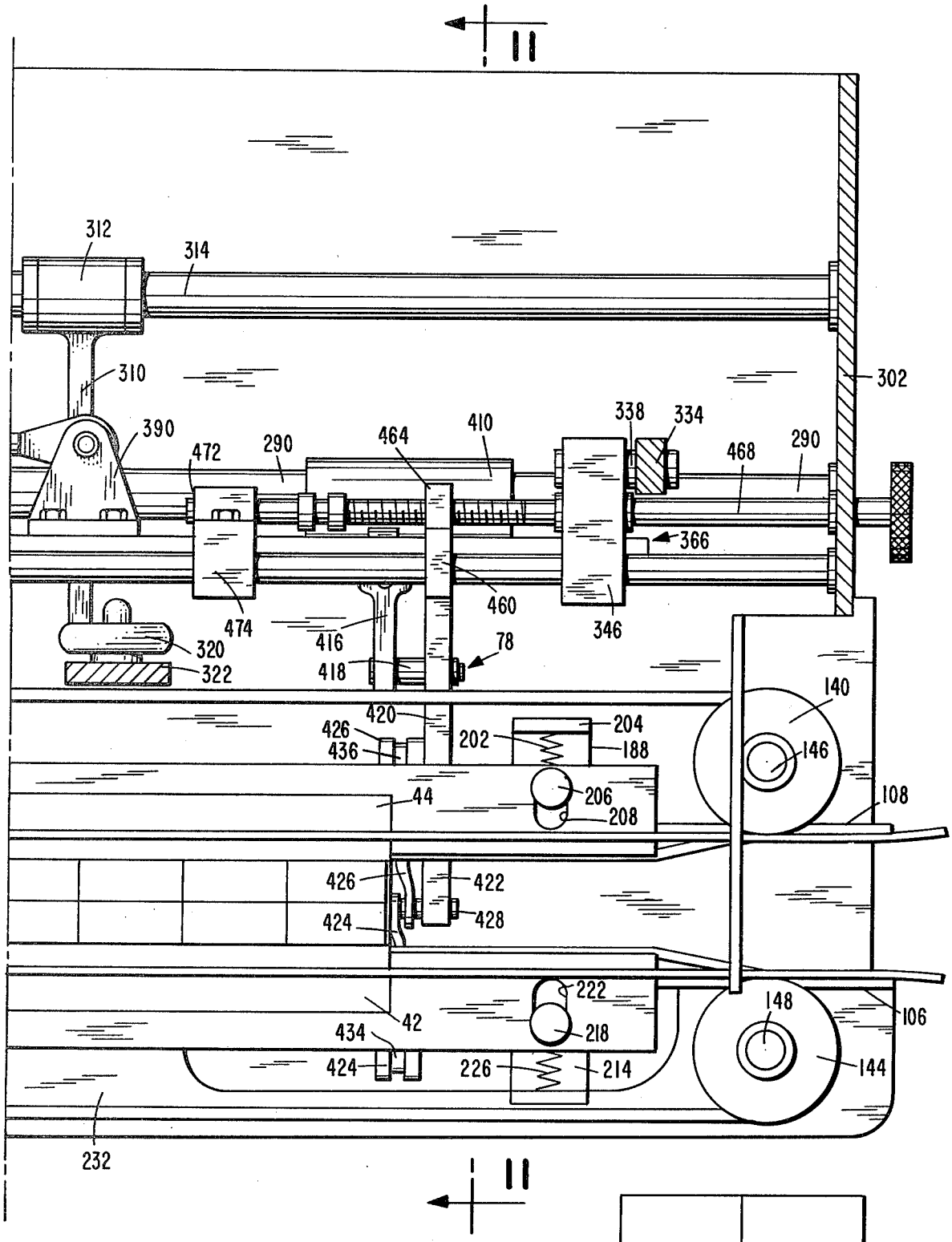
FIG. 13 illustrates the relationship of FIGS. 13A and 13B.

To keep the carton in the center of the guide channel, and to provide a positive grip on each carton so that it will be carried rapidly into contact with the stop assembly and, upon release of the stop, will be immediately carried out of the machine so that it will not interfere with the next arriving carton, the drive belts 58 and 60 are biased against the sides of the carton by means of spring loaded pressure bars 182 and 184, respectively (see FIGS. 12A and 12B which, for convenience, are herein referred to together as FIG. 12. Bar 182 is mounted for reciprocating motion toward and away from the path followed by the cigarette cartons, and is supported by a pair of brackets 186 and 188. As illustrated in FIG. 11, bracket 186 includes a horizontal surface 190 on which the pressure bar rests and is supported for its reciprocating motion, with the bracket including a downwardly extending arm 192 which is supported on a convenient frame element such as the guide wall 108. At its outer end, the bracket includes an upwardly turned shoulder portion 194 which receives and holds one end of a compression spring 196. The opposite end of the spring abuts against the back surface of the pressure bar 182 to urge the bar forwardly toward engagement with the carton. The bar is held in place on bracket 186 by means of a stud 198 which passes through an elongated slot 200 formed in the pressure bar, the stud having an enlarged head portion to permit easy sliding, but to prevent the bar from lifting off the bracket.

Bracket 188 similarly includes an upper horizontal surface which supports the pressure bar 182 for motion toward and away from the cigarette carton, with the bar being urged forwardly into contact with the carton by a compression spring 202 extending between a shoulder 204 and the back surface of the compression bar. Again, the bar is held in place on the bracket 188 by means of a stud 206 mounted in an elongated slot 208 formed in the pressure bar.

The front surface of the pressure bar includes a shaped slot or groove 210 (FIG. 11) which extends the length of the bar and which receives and guides the drive belt 58. The groove is sufficiently deep to provide a positive guide for the drive belt, but it is shallow enough to insure that a portion of the drive belt will extend out and will engage the carton side.

In similar manner, the pressure bar 184 is mounted on a pair of brackets which may be secured to the guide wall 106 or some other suitable housing member, the pressure bar being mounted on these brackets by studs 216 and 218 extending through corresponding slots 220 and 222, respectively. Again, the pressure bar is biased toward the guide channel and thus against the sides of the cartons passing through the stamping section by means of compression springs 224 and 226 which are secured between the brackets 212 and 214 and the back surface of the pressure bar 184.

As generally indicated in FIG. 11, as a matter of convenience the guide wall 106, the pressure bar 184 and its supporting brackets 212 and 214 are carried on a support housing wall 230, to which the bearing blocks 180 and 178 are secured. A forwardingly extending horizontal brace 232 which provides rigidity to the structure also may be secured to wall 230, and this wall, as well as the related mechanism may be pivotally mounted on a horizontal hinge shaft 234 by means of spaced hinge brackets such as the bracket 236. This hinged mounting allows the whole assembly to be pivoted forwardly away from the remainder of the machine to expose the support platform and the stop mechanism for such maintenance and repair as may be required.

Figure 13A:
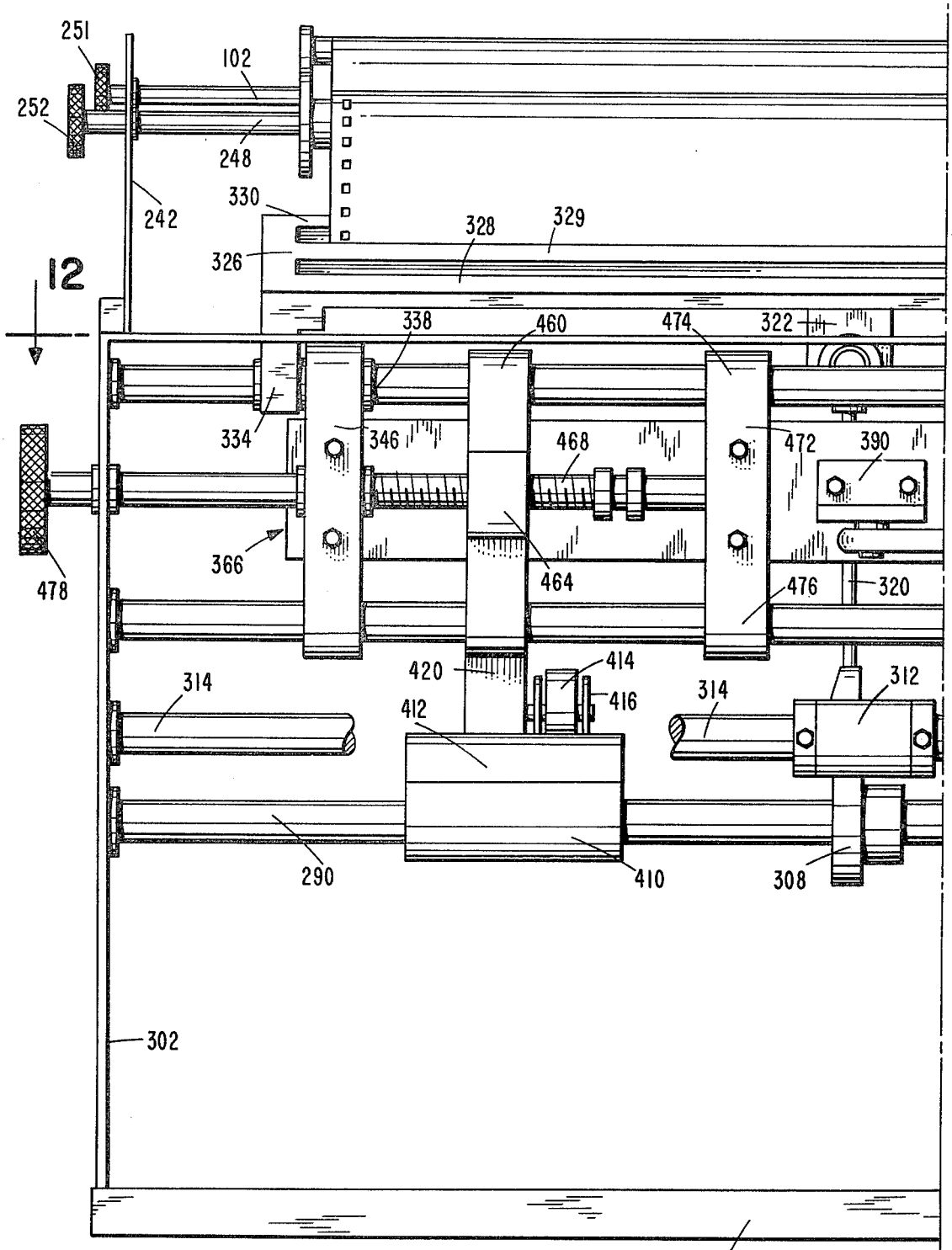
FIGS. 13A and 13B are a rear view of the stamping section of the assembly of FIG. 1, illustrating the drive mechanism for the apparatus.
Figure 13B:
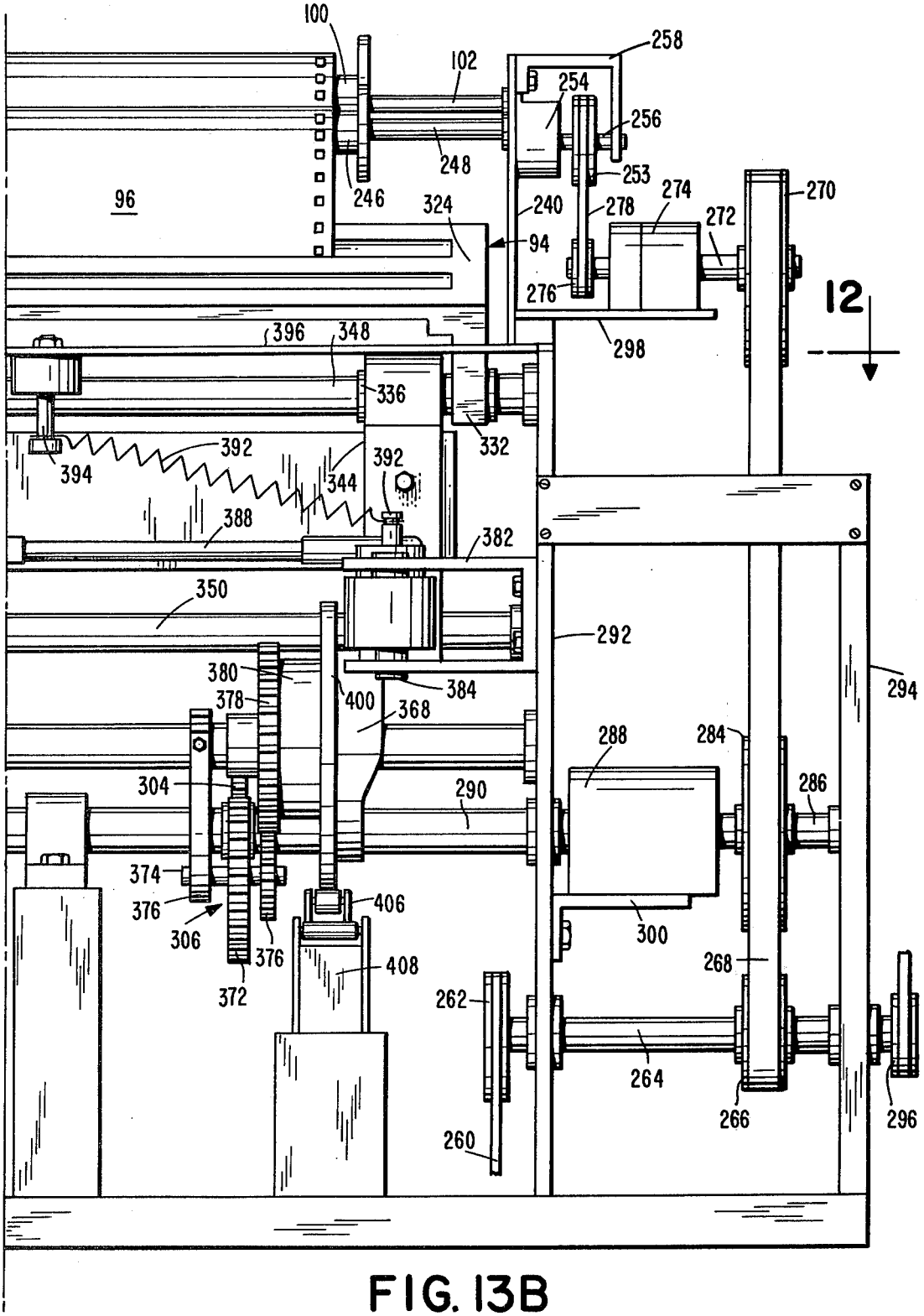

Referring now to FIGS. 3 and 11, and to the rear plan view of the machine of FIGS. 13A and 13B which, taken together, comprise what will hereinafter for convenience be referred to as FIG. 13, it will be seen that the roll 100 from which the transfer sheet 96 is supplied is mounted on a shaft 102 which extends between and is journalled in a pair of end walls 240 and 242, which are a part of the machine housing, the roll being adapted for rotation to supply the transfer sheet as required. Preferably, roll 100 will be subjected to a predetermined amount of drag to insure proper feed of the transfer sheet in known manner. As may be seen in FIG. 11, the transfer sheet is fed downwardly and around the spacing bar 104, horizontally across the transfer station, around a second spacing bar 244 and upwardly to a take-up reel 246. Reel 246 is mounted on a shaft 248 which is also journalled between end walls 240 and 242. Just below the spacing bars 104 and 244, and generally parallel thereto, are a pair of horizontal guide bars 249 and 250 which extend along and slightly outside the guide channel along which the cartons are carried. As shown in FIG. 12, these guide bars extend beyond the ends of the stamping station and are slightly curved outwardly and upwardly at the entry end of the station. These bars engage the flaps 42 and 44 of each carton of cigarettes as it is received from the opener station and hold the flaps down out of the way of the transfer applying mechanism as the carton is carried through the stamping section.

As shown in FIG. 13, shafts 102 and 248 may be provided with hand wheels 251 and 252, respectively, for manual adjustment of the transfer sheet. In normal operation, however, the take-up reel 246 is driven by a power take-off pulley 253 through an electrically operated clutch mechanism 254. The power take-off pulley is mounted on a shaft 256 which is supported by a suitable bracket 258 carried by end wall 240. The clutch 254 is normally de-energized, but when activated, it serves to drive take-up reel 246 to advance the transfer sheet a sufficient distance to align two rows of stamps with the rows of platen heater elements 92. Normally, this clutch is activated after every third operation of the platen, and may be operated under the control of a simple counter mechanism responsive to activation of the platen.

Operating power for the stamp transfer machinery is provided by a suitable electric motor mounted on or below the stamping section housing 109, and may for convenience be secured to the support frame 56 or to the housing 109. The output shaft of the motor is connected by way of a drive belt 260 and pulley 262 to a main power shaft 264 through which the various drive mechanisms for the opener section, the stamping section and the resealing section are connected. Although the various drive connections are shown as utilizing drive belts and pulleys, it will be apparent that suitable sprockets and drive chains may be used where appropriate.

Power to drive the transfer sheet advancing mechanism is obtained from the power shaft 264 by way of a drive pulley 266 and the main stamping section drive belt 268 which preferably is a toothed drive belt, and which extends upwardly to the transfer sheet drive pulley 270. This pulley is connected through a transfer shaft 272 mounted in a suitable bearing housing 274, a pulley 276, and a drive belt 278 to drive the power take-off pulley 253.

As illustrated in FIG. 12, a drive belt 268 also passes around a pulley 280 which is mounted on a power shaft 282 to provide drive power for a pulley 283 which carries the previously-described belt 164 leading to the conveyor mechanism used to advance the cartons through the transfer station. Also driven by belt 268 is a large clutch drive pulley 284 mounted on a clutch shaft 286 which comprises the input to a single revolution clutch 288. This is an electrically operated clutch which, when activated, operates to connect the input shaft to its output to rotate output shaft 290 a single revolution. Shaft 290 may thus be activated periodically to rotate once, to drive the various cam mechanisms to be described which operate the stamping section components in the manner described above.

The stamping section housing 109 includes a pair of spaced vertical walls 292 and 294 which serve to enclose and support the various power shafts 264, 282 and 286 which are carried by suitable journals mounted on these walls. Power shaft 264 passes through wall 294 and carries additional power drive pulleys, such as pulley 296, which serve to supply power to the adjacent sections of the apparatus. Additionally, various support brackets and the like are provided as required to secure various elements such as the gearing housing 274 and the single revolution clutch 288, shown as being mounted on brackets 298 and 300, respectively. These frame elements are shown diagrammatically and are merely illustrative, such frame elements being matters of conventional construction techniques, and not constituting a part of the present invention. The opposite end of the applicator section is similarly closed by a vertical wall 302 which protects and supports the operating mechanism to be described.

The single revolution clutch 288 is activated each time a carton of cigarettes is positioned in the transfer station 76. A microswitch or like sensor may be provided in the guide channel through which the carton travels, near the stop mechanism, for example, to produce an electric signal when the carton is properly positioned. This signal activates clutch 288 to produce a single revolution of shaft 290. The rotation of this shaft produces four interrelated and synchronized functions within the machine. First, the rotation of shaft 290 causes the stamping frame 94 to be released so that it can move downwardly under spring action to press platen 90 and heating elements 92 against the back surface of transfer sheet 96 to transfer tax stamps to the packages in the carton. Continued rotation of shaft 290 then returns the stamping frame to its initial position. The second function of shaft 290 is to operate the stop assembly 78 so that it opens after the completion of the stamp transfer operation to allow the carton to move out of the transfer station. Continued rotation of the shaft then recloses the stop assembly to halt the next arriving carton. During the operation of the stop assembly, the rotation of shaft 290 also advances a cam mechanism which shifts the stamping frame 94 and platen 90 laterally with respect to the transfer sheet to align it with the next set of stamps to be transferred; this shifting of the platen is the third operation performed by shaft 290. Finally, rotation of the shaft advances a transfer sheet cam which operates every third activation of shaft 290 to advance the transfer sheet 96 to bring two fresh rows of stamps into the transfer station. The mechanisms by which these functions are carried out will now be described with respect to FIGS. 11, 12, 13 and 14, to which reference is now made.

The output shaft 290 is journalled in walls 292 and 302 and carries a spur gear 304 which drives a gear train generally indicated at 306 and which will be described in detail below. Shaft 290 also carries a stamping cam 308 which is keyed thereto and rotates upon actuation of shaft 290 to allow the platen frame to move downwardly and thereafter returns it to its initial position. This is accomplished by means of a cam follower arm 310 which is pivotally mounted at 312 to a shaft 314 which is journalled in end walls 292 and 302. Arm 310 carries a cam roller 316 which rests on the surface of cam 308 and which rotates the arm about its pivot 312 in accordance with the shape of the cam. As shown in FIG. 11, the cam has a single high lobe 318 which drives the cam arm 310 upwardly to lift the platen stamping frame 94. This lifting action is accomplished through a linkage arm 320 connected between the free end of cam follower arm 310 and a connector 322 secured to frame 94.

The stamping frame is illustrated as consisting of a pair of side rails 324 and 326 and three spaced, laterally extending, bridging rails 328, 329 and 330 located at the rear, center and forward portions of the frame, respectively, and interconnecting the two side rails. At the rearward end of each of the side rails are depending flanges 332 and 334 by means of which the stamping frame is pivotally mounted on pivot shafts 336 and 338, respectively. As shown most clearly in FIGS. 11 and 14, the stamping frame is pivotally mounted at its back end, in the area of the rearmost bridging rail 328. The linkage arm connector 322 is mounted at the approximate midpoint of the middle rail 329, and the platen 90 is mounted on the forward bridging rail 330. The stamping frame is biased downwardly by a suitable spring arrangement such as the coil springs 340 and 342 connected between the side rails 324, 326 and the slidable mounting brackets 344 and 346 which carry the stamping frame. The coil springs urge the stamping frame downwardly to its tax stamp transferring position, while the cam linking arm 320 holds the frame in its upward position when the cam follower arm is in contact with the cam lobe 318.

When rotation of output shaft 290 carries cam 308 to the point where the cam roller falls off the cam lobe, linkage arm 320 releases the stamping frame and springs 340 and 342 carry the platen down to effect the transfer of stamps. This spring drive of the stamping frame permits slight variations in the height of the cigarette packages while still insuring a firm application of the tax stamps, for the spring loading accommodates such variations in a way that a positive mechanical drive could not do. However, there is a positive mechanical drive on the return motion of the frame so that the carton will be released by the platen for advancement out of the transfer station.

The slidable mounting brackets 344 and 346 are carried on a pair of guide shafts 348 and 350 which extend across the stamping section of the machine and are supported by the end walls 292 and 302. These shafts do not rotate, but provide a strong base along which the mounting brackets can slide to provide lateral adjustment of the platen.

Figure 14:
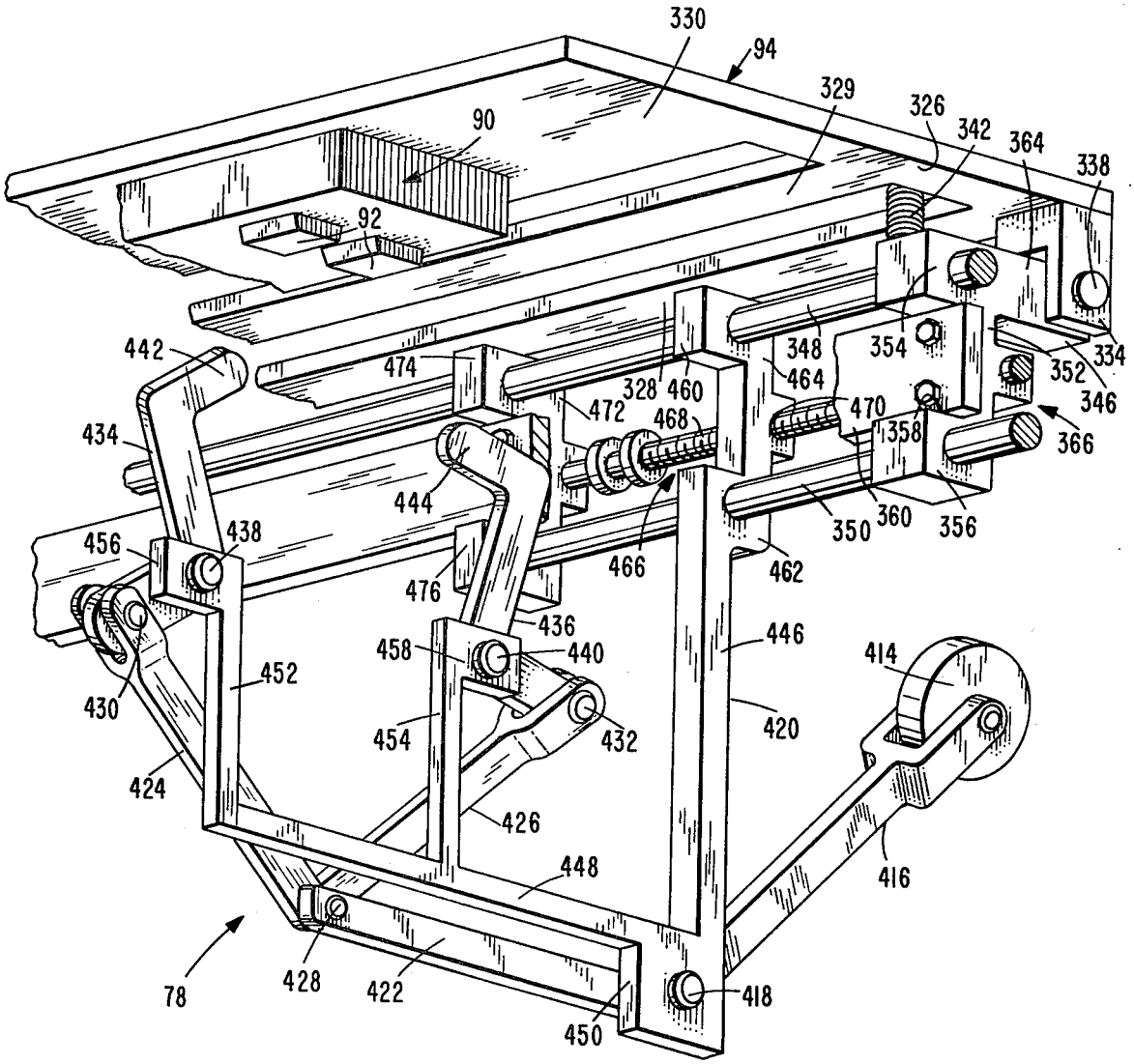
FIG. 14 is a perspective view of the platen assembly of the stamping section and of the carton stop mechanism mounted thereon.

As most clearly shown in FIG. 14, the mounting brackets 344 and 346 include a vertical web portion indicated on bracket 346 at 352, this web portion extending between, and connecting, upper and lower bushing blocks 354 and 356, respectively, each of which is formed with an aperture adapted to slidably receive shafts 348 and 350, respectively. The bushing blocks and the joining web define a forwardly facing channel 358 adapted to receive a tie plate 360 which is parallel to the guide shafts and is secured to the two mounting brackets to form a rigid carrier for the stamping frame. The two mounting brackets include rearwardly projecting support arms 362 and 364 which receive and support the pivot shafts 336 and 338, respectively, by means of which the stamping frame 94 is pivotally secured to the platen carrier, which may be generally indicated by the numeral 366.

The lateral motion of the platen carrier 366 is accomplished by means of a platen positioning cam 368 and its associated cam follower arm 370 (see FIGS. 11 and 12). Cam 368 is mounted for rotation about shaft 314, this cam being driven by gear train 306. The gear train comprises a spur gear 372 which is mounted on an idler shaft 374 that is supported by a bracket 376 clamped onto shaft 314. Gear 372 is driven by the spur gear 304 keyed onto main drive shaft 290 to rotate shaft 374 and drive spur gear 374 which is keyed onto shaft 374 to rotate with it. Spur gear 376 drives a cam gear 378 that is connected to and forms a part of cam element 380 which, in turn, carries the cam surface 368.

The gear train 306 steps down the rotation of output shaft 290 so that the cam element 380 turns only 1/6 of a revolution for each complete revolution of shaft 290. Cam face 368 is formed with six segments at three different heights corresponding to the three different locations of the platen and stop assemblies required to apply the three sets of transfer stamps on the transfer sheet 96. Thus, as may be best seen in FIG. 12, the first segment has a high cam level which shifts cam follower arm 370 to the left, and which therefore corresponds to the left-hand position of the platen, illustrated in FIG. 5. The second segment includes an intermediate level which shifts the arm 370 to the right, and which corresponds to the middle position of the platen shown in FIG. 6. The third segment is at a lower level which corresponds to the right-hand position of the platen with respect to the transfer sheet, shown in FIG. 7. Thus, in the preferred form of the invention, three consecutive activations of clutch 288 produce corresponding rotations of the cam which cause the platen to move from its left-hand position to its right-hand position, applying the three sets of tax stamps from a given pair of rows on the transfer sheet. Thereafter, the sheet is advanced and the cam 368 rotates to its fourth segment, which is at a low level to cause the platen to remain in its right-hand position. The transfers are applied from that position, the cam rotates to its fifth segment to shift cam arm 370 to apply stamps from the middle position, and a final rotation of the cam returns the platen to its left-hand position. These six steps complete a single rotation of cam 368 and comprise a cycle of operation.

The cam follower arm 370 is pivotally mounted to a bracket 382, which may be mounted on wall 292, by means of a vertical pivot shaft 384. The follower arm extends from the pivot point past the cam face, and carries a cam follower roller 386 which contacts the cam face to cause the arm to pivot in accordance with the angular position of the cam. The free end of the cam follower arm is connected by way of a linkage arm 388 to a connector bracket 390 mounted on the tie plate portion of the platen carrier 356, whereby pivotal motion of the cam follower arm is transferred into the lateral motion of the platen carrier described above. The cam arm is biased into contact with the cam face by means of a suitable tension spring 392 which may be secured between a mounting post 394 carried on the cam arm 370 and a mounting post 394 mounted on a top plate 396 which forms a part of the machine frame (see FIG. 13).

The cam element 380 also carries a second cam surface 400 which, as may best be seen in FIG. 11, incorporates two diammetrically opposed lobes 402 and 404. These lobes are designed to contact and operate a switch arm 406 which operates a conventional microswitch 408. This switch controls the operation of the electrically operated clutch mechanism 254 to advance the transfer sheet 96 when required. The two lobes 402 and 404 are so positioned on cam 400 as to activate the microswitch after each third advance of the cam element 380, and thus after each third activation of the platen assembly, thus providing six sets of tax stamps for each full cycle of operation.

The stop assembly 78, illustrated in perspective in FIG. 14, is operated by a stop trigger cam 410 mounted on and keyed to shaft 290 and thus rotates one complete turn each time the single revolution clutch 288 is activated. Cam 410 includes a single lobe 412 (FIG. 11) which engages a cam roller 414 mounted at one end of a cam follower arm 416. The cam arm 416 is pivotally mounted, by means of a pivot pin 418, to a stop assembly support frame 420 so that the free end 422 of the follower arm 416 moves vertically as the cam 410 rotates and the roller passes over the lobe 412. A pair of linkage arms 424 and 426 are pivotally connected by a pivot pin 428 to the free end of the follower arm, with the opposite ends of the linkage arms being connected by respective pivot pins 430 and 432 to a pair of stop elements 434 and 436. These stop elements are pivotally connected by way of pivot pins 438 and 440 to the support frame 420 for pivotal motion in response to rotation of the stop trigger cam 410. The stop elements incorporate inwardly extending arm portions 442 and 444, respectively, which, in the rest position of the stop assembly, extend over the support platform 62, and into the path of any cigarette carton being drawn along that platform. In FIG. 11, the stop mechanism is illustrated in the activated condition, with roller 414 being lifted by lobe 412 on the stop trigger cam. This position of the cam rotates the free end 422 of the cam follower arm downwardly to thereby pivot the stop elements 434 and 436 outwardly away from the path of carton 40 (see FIG. 11). Continued rotation of the cam will return the stop elements to the dotted line positions 442' and 444' to block passage of a carton.

The support frame 420 is generally L-shaped, in the illustrated embodiment, having a vertical leg portion 446 and a horizontal leg portion 448 which join at a downwardly extending ear portion 450, the ear portion providing the support for the pivot pin 418. The horizontal leg 448 carries first and second spaced vertical support posts 452 and 454 which carry at their upper ends outwardly extending ears 456 and 458, respectively, which in turn support the pivot pins 438 and 440.

The vertical leg 446 of the support frame 420 is formed with a pair of vertically spaced bushing blocks 460 and 462 which are joined by an offset web portion 464 to form a channel 466 which is adapted to fit over the tie-plate 360 for slidable motion with respect thereto. The two bushing blocks 460 and 462 incorporate through apertures which slidably receive the guide shafts 348 and 350. Since the support frame is not secured to tie plate 360, it is movable along the guide shafts with respect to the platen carrier assembly 366. This relative motion is controlled, however, by means of a threaded indexing shaft 468 which passes through a threaded aperture 470 in the web portion 464 of the support frame. One end of shaft 468 is secured in an end bracket 472, the shaft being rotatable in the bracket, but secured against longitudinal motion with respect to it. Bracket 472 is mounted by means of upper and lower bushing block sections 474 and 476 to guide shafts 348 and 350, respectively, and is secured to tie plate 360 to form a part of, and be movable with, the platen carrier 366, the bushing blocks providing support and guidance for the assembly.

At its other end, shaft 468 passes through an aperture in the web portion 352 of mounting bracket 346 and extends through a suitable bushing in wall 302 to terminate in a hand wheel 478 which permits manual rotation of the shaft. Rotation of shaft 468 threads support bracket 420 along shaft 468, causing bracket 420 to slide along the guide shafts 348 and 350 and thereby adjusting the position of the support bracket with respect to the platen carrier 366. However, when the shaft 468 is not rotated, the support frame 420 is firmly secured to the platen carrier 366 by means of the connection provided by shaft 468 to end bracket 472 so that the support bracket 420 and its associated stop assembly will move along guide shafts 348 and 350 with the motion of the platen carrier 366. Thus, it will be apparent that the position of the stop arms 442 and 444 can be varied with respect to the location of the platen 90, but that when the platen is shifted from one stamp applying location to the next, the stop assembly will move with it.

The operation of the stamping section may be summarized as follows. The continuously operating conveyor assembly including drive belts 58 and 60 carry each cigarette carton in turn along platform 62 until the carton is halted by the stop assembly 78. When a carton moves into this position, it produces a signal, as by closing a microswitch, which activates the single rotation clutch 288, causing output shaft 290 to rotate a single revolution. This in turn causes the platen stamp cam 308 to rotate once, allowing the platen to be driven downwardly against the transfer sheet to transfer a set of stamps to the packages contained in the carton. The cam then lifts the platen away from the carton. The rotation of shaft 290 causes the stop trigger cam 412 also to rotate, this cam being synchronized with the platen stamp cam 308 so that upon completion of the stamping operation of the platen the stop assembly 78 is activated to release the carton. Each rotation of output shaft 290 results in a partial rotation of cam element 380 to activate cam follower arm 370 so that the platen will be repositioned with respect to the transfer sheet. The angular relationship of the cam surface 368 and the stamp cam 308 is such that lateral shifting of the platen takes place after completion of the stamping operation. Three energizations of the single rotation clutch 288 will move the platen from its left-hand position to its middle position and then to its right-hand position, exhausting all of the tax stamps on two rows of the transfer sheets. At that time, cam 400 will activate switch 406 to energize clutch 274, advancing the transfer sheet to bring two fresh rows of tax stamps into the transfer station, and three additional energizations of the single revolution clutch 288 will return the platen to its original position and complete a cycle of operation. This cycle then repeats as long as cartons are fed to the conveyor mechanism to activate the carton sensing microswitch.

Because the cartons pass through the transfer station in their upright position, application of the stamps may be monitored by an operator who may make fine adjustments of the platen position during operation, if required. Normally, however, the height of the platform 62 and the specific location of the stop assembly with respect to the platen will be adjusted before a run of cartons is initiated so that the applicator machine is properly adjusted.

Thus, it will be apparent that the applicator section provides an accurate yet easily controllable means for applying tax stamps to cigarette cartons, and this applicator station, in combination with the opener and closure sections described with respect to FIG. 1, provide an inexpensive, yet effective and easily controlled machine for applying tax stamps or other transfers to cigarette packages. Although the invention has been described in terms of a preferred embodiment, it will be understood by those of skill in the art that numerous variations and modifications may be made without departing from the true spirit and scope thereof as set forth in the following claims.

I claim:

1. Apparatus for applying transfers to packages, comprising:

a transfer sheet having a plurality of sets of transfers for application to corresponding packages;

platen means for applying said transfers to said packages;

means for shifting said platen means with respect to said transfer sheet to align the platen with selected sets of transfers;

continuously operating conveyor means for transporting packages through a transfer station adjacent said transfer sheet; and a stop assembly shiftable with respect to said transfer sheet and with respect to said conveyor means to halt said packages at preselected locations with preselected portions of said packages in alignment with said platen.

2. The apparatus of claim 1, further including means for shifting said stop assembly in synchronism with the shifting of said platen, whereby said packages and said platen are both aligned with the same set of tranfers.

3. The apparatus of claim 2, further including adjustment means for said stop assembly for varying the alignment of said platen with said packages.

4. The apparatus of claim 1, wherein said stop assembly is connected to said platen means, whereby said stop assembly is shifted with said platen means for aligning said packages with said platen means for the application of transfers.

5. The apparatus of claim 4, further including adjustment means for varying the position of said stop assembly with respect to said platen means, whereby the alignment of said packages with said platen means can be varied.

6. The apparatus of claim 5, further including drive means for activating said stop assembly and operable intermittently to halt said packages for the application of said transfers and then to release said packages for transport out of said transfer station, said continuously-operating conveyor means holding said packages against said stop assembly during the application of the transfers to provide accurate alignment of the transfers with corresponding packages.

7. The apparatus of claim 1, wherein said conveyor means is biased into contact with said packages to provide a positive drive through said transfer station.

8. The apparatus of claim 7, wherein said conveyor means comprises a pair of drive belts disposed on opposite sides of said packages, said drive belts being spring-biased to engage the sides of said packages.

9. The apparatus of claim 1, wherein said packages are cigarette packages contained in cartons, said conveyor means transporting cartons through said transfer station in spaced sequential relationship.

10. The apparatus of claim 9, further including drive means for intermittently activating said stop assembly to halt and then release each carton in turn for the application of a set of transfers to corresponding packages in each carton.

11. The apparatus of claim 10, further including means for synchronizing the movement of said means for shifting said platen means with the movement of said shiftable stop assembly, whereby each carton in turn is aligned with a corresponding set of transfers and with said platen for application of one each of said corresponding set of transfers to each package in the carton.

12. The apparatus of claim 11, further including adjustment means for said stop assembly for varying the position of said stop assembly with respect to said platen means, whereby the location of said transfers on said packages may be selectively varied.

13. The apparatus of claim 10, further including means for feeding open cartons of cigarette packages to said conveyor means, said packages being in an upright position with one end exposed for application of said transfers.

14. The apparatus of claim 13, wherein said means for feeding open cartons of cigarette packages comprises a carton opener, means for delivering cartons sequentially to said opener, and means for delivering opened cartons to said conveyor means.

15. The apparatus of claim 14, wherein said conveyor means ejects said cartons from said transfer station upon their release by said stop assembly, and further including carton closure means for receiving and closing said cartons.

16. The apparatus of claim 15, wherein said carton opener, said transfer station and said carton closure means each are modular, separable assemblies, said apparatus further including means for securing said modular assemblies together to provide a continuous carton handling apparatus for opening cartons, applying transfers to each package thereon, and closing the cartons.

17. The apparatus of claim 16, further including a common drive means for said modular assemblies to provide synchronous operation thereof.

18. Apparatus for automatically applying selected sets of transfers from a sheet of transfers to a plurality of packages contained in a carton, comprising:

housing means defining a transfer station;

means for mounting a transfer sheet adjacent said transfer station;

a platen means mounted for motion toward and away from said transfer station;

means for shifting said platen means laterally with respect to said transfer station and said transfer sheet mounting means;

continuously operating conveyor means for transporting cartons containing packages through said transfer station; and a stop assembly in said transfer station for interrupting the motion of the cartons through said transfer station, said stop assembly being shiftable with respect to said transfer station and with respect to said platen means to stop said cartons at selected, adjustable locations within the transfer station.

19. The apparatus of claim 18, wherein said stop assembly is connected to said platen means for motion therewith.

20. The apparatus of claim 19, further including adjustment means for shifting the position of said stop assembly with respect to said platen means.

21. The apparatus of claim 18, wherein said conveyor means comprises a pair of drive belts continuously operating to hold cartons against said stop assembly when the stop assembly interrupts the motion of the cartons through said transfer station.

22. The apparatus of claim 21, further including means for driving said platen means toward a carton positioned against said stop assembly and within the transfer station, whereby a set of stamps from a transfer sheet can be applied to the packages in the carton, and means to thereafter withdraw said platen means.

23. The apparatus of claim 22, further including means for activating said stop assembly to halt the motion of said cartons, and for thereafter activating said stop assembly to permit said conveyor means to carry cartons out of said transfer station.

24. The apparatus of claim 18, wherein said means for shifting said platen means with respect to said transfer station comprises a first stepped cam means and means for periodically activating said first cam means.

25. The apparatus of claim 24, wherein said stop assembly is connected to said platen means, whereby activation of said first cam means shifts said stop assembly laterally along said transfer station.

26. The apparatus of claim 24, further including adjustable mounting means for mounting said stop assembly on said platen means, whereby activation of said first cam means shifts said stop assembly laterally with respect to said transfer station simultaneously with the lateral shifting of said platen means.

27. The apparatus of claim 26, wherein said adjustable mounting means comprises means for varying the relative positions of said platen means and stop assembly, whereby the location of a carton, when stopped, with respect to said platen means may be selectively varied.

28. The apparatus of claim 27, further including drive means for driving said platen means toward said transfer station and second cam means for thereafter withdrawing said platen means.

29. The apparatus of claim 28, further including third cam means for activating said stop assembly to permit said conveyor means to carry cartons out of said transfer station.

30. The apparatus of claim 29, further including common drive means for said first, second, and third cam means.

31. The apparatus of claim 30, wherein said common drive means comprises a single revolution clutch and an output shaft which rotates once each time said clutch is activated, said second and third cam means being mounted on said output shaft for rotation therewith to withdraw said platen means and activate said stop means in synchronization.

32. The apparatus of claim 31, wherein said means for activating said first cam means includes gear means on said output shaft for driving said first cam.

33. The apparatus of claim 29, wherein said stop assembly includes a pair of stop elements pivotally mounted for motion into and away from said transfer station, and linkage means responsive to said third cam for driving said stop elements.

34. The apparatus of claim 18, wherein said stop assembly includes a support frame secured to said platen means and at least one stop element pivotally mounted on said support frame for motion into and out of the path of said cartons.

35. The apparatus of claim 34, wherein said platen means includes a platen carrier mounted for motion laterally along said transfer station, a stamping frame pivotally mounted on said platen carrier, a platen supported on said stamping frame and extending over said transfer station, and a plurality of heating elements carried by said platen.

36. The apparatus of claim 35, further including a pair of guide shafts extending parallel to said transfer station, said platen carrier being mounted on said guide shafts for slidable movement therealong.

37. The apparatus of claim 34, further including adjustable mounting means for securing said stop assembly support frame to said platen means, said mounting means including a threaded adjusting shaft for securing said support frame to said platen means so that rotation of said adjusting shaft adjusts the location of said stop assembly with respect to said platen means.

38. The apparatus of claim 18, wherein said transfer station includes a support platform for receiving cartons, said support platform being vertically adjustable to accommodate said apparatus to cartons of various sizes.

39. The apparatus of claim 38, wherein said conveyor means comprises spring-biased drive means adapted to grip cartons of various sizes to carry them through said transfer station.

40. The apparatus of claim 1, wherein said stop assembly includes a support frame secured to said platen means, and at least one stop element pivotally mounted on said support frame for motion into and out of the path of said cartons.

41. The apparatus of claim 40, further including adjustable mounting means for securing said stop assembly support frame to said platen means, said mounting means including a threaded adjusting shaft for securing said support frame to said platen means so that rotation of said adjusting shaft adjusts the location of said stop assembly with respect to said platen means.

42. The apparatus of claim 41, wherein said platen means comprises a platen carrier mounted for motion laterally along said transfer station, a stamping frame pivotally carried on said platen carrier, and a platen supported on said stamping frame for motion toward and away from said transfer sheet.

43. The apparatus of claim 42, wherein said adjustable mounting means secures said stop assembly support frame to said platen carrier, whereby said stop assembly is movable laterally along said transfer station with said platen means.

* * * * *